US009421421B2

(12) United States Patent
Knutson et al.

(10) Patent No.: US 9,421,421 B2
(45) Date of Patent: Aug. 23, 2016

(54) GOLF CLUB WITH IMPROVED WEIGHT DISTRIBUTION

(71) Applicant: Acushnet Company, Fairhaven, MA (US)

(72) Inventors: Scott A. Knutson, Escondido, CA (US); Daniel Stone, Long Beach, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/665,329

(22) Filed: Mar. 23, 2015

(65) Prior Publication Data

US 2015/0258398 A1 Sep. 17, 2015

Related U.S. Application Data

(63) Continuation-in-part of application No. 14/214,025, filed on Mar. 14, 2014, now Pat. No. 9,211,456.

(51) Int. Cl.

| | |
|---|---|
| ***A63B 53/16*** | (2006.01) |
| ***A63B 24/00*** | (2006.01) |
| ***A63B 53/14*** | (2015.01) |

(Continued)

(52) U.S. Cl.

CPC ..... *A63B 24/0003* (2013.01); *A63B 21/0608* (2013.01); *A63B 21/075* (2013.01); *A63B 21/08* (2013.01); *A63B 24/0006* (2013.01); *A63B 53/14* (2013.01); *A63B 57/00* (2013.01); *A63B 60/02* (2015.10); *A63B 60/16* (2015.10); *A63B 60/22* (2015.10); *A63B 60/24* (2015.10); *A63B 60/42* (2015.10); *A63B 2024/0056* (2013.01); *A63B 2024/0068* (2013.01);

(Continued)

(58) Field of Classification Search

CPC ..... A63B 24/0003; A63B 2220/20; A63B 2220/24; A63B 53/14; A63B 60/22; A63B 60/24; A63B 21/08; A63B 21/0608; A63B 21/075; A63B 24/0006; A63B 2024/0056; A63B 2024/0068; A63B 2220/34; A63B 57/00; A63B 60/02; A63B 60/16; A63B 60/42

See application file for complete search history.

(56) References Cited

U.S. PATENT DOCUMENTS 1,167,387 A 1/1916 Daniel
1,831,255 A 11/1931 Menzies (Continued)

FOREIGN PATENT DOCUMENTS

JP 2012-016560 A 1/2012

OTHER PUBLICATIONS

GoPro Hero HD Club Cam (http://www.youtube.com/watch?v=JBC3D2xOgHI), posted Mar. 8, 2011, 6 pages.
U.S. Appl. No. 14/214,025, filed Mar. 14, 2014, Barksdale et al.

*Primary Examiner* — Stephen Blau
(74) *Attorney, Agent, or Firm* — Kevin N. McCoy

(57) ABSTRACT

A weight member for optimizing weight distribution of a golf club, comprising a removable weight member configured to reside within a shaft of the golf club, the shaft having a proximal end and a distal end, the proximal end opposite a head of the golf club, the distal end adjacent the head of the golf club, the weight member comprising a heavy weighted portion, the heavy weighted portion offset distally from the proximal end of the shaft, the weight member comprising a plurality of locating members, the plurality of locating members configured to limit movement of the heavy weighted portion relative to an inner wall of the shaft.

18 Claims, 35 Drawing Sheets

(51) Int. Cl.

| | |
|---|---|
| ***A63B 21/08*** | (2006.01) |
| ***A63B 21/06*** | (2006.01) |
| ***A63B 21/075*** | (2006.01) |
| ***A63B 57/00*** | (2015.01) |

(52) U.S. Cl.

CPC ..... *A63B 2220/20* (2013.01); *A63B 2220/24* (2013.01); *A63B 2220/34* (2013.01)

(56) References Cited

U.S. PATENT DOCUMENTS

| | | | | |
|---|---|---|---|---|
| 2,051,083 | A | 8/1936 | Hart | |
| 2,782,035 | A | 2/1957 | East | |
| 2,992,828 | A | 7/1961 | Stewart | |
| 3,075,768 | A | 1/1963 | Karns | |
| 3,270,564 | A | 9/1966 | Evans | |
| 3,606,327 | A | 9/1971 | Gorman | |
| 3,792,863 | A | 2/1974 | Evans | |
| 3,945,646 | A | 3/1976 | Hammond | |
| 4,461,479 | A | 7/1984 | Mitchell | |
| 4,674,746 | A | 6/1987 | Benoit | |
| 4,690,407 | A | 9/1987 | Reisner | |
| 4,887,815 | A | 12/1989 | Hughes et al. | |
| 4,936,586 | A | 6/1990 | Van Raemdonck | |
| 4,988,102 | A | 1/1991 | Reisner | |
| 5,076,121 | A | 12/1991 | Fosella | |
| 5,090,273 | A | 2/1992 | Fosella | |
| 5,152,527 | A | 10/1992 | Mather et al. | |
| 5,207,129 | A | 5/1993 | Fosella | |
| 5,244,209 | A | 9/1993 | Benzel | |
| 5,305,670 | A | 4/1994 | Fosella et al. | |
| 5,351,952 | A | 10/1994 | Hackman | |
| 5,448,931 | A | 9/1995 | Fosella et al. | |
| 5,465,967 | A | 11/1995 | Boeckenhaupt | |
| 5,474,298 | A | 12/1995 | Lindsay | |
| 5,569,099 | A | 10/1996 | Jackson | |
| 5,575,722 | A | 11/1996 | Saia et al. | |
| 5,591,091 | A | 1/1997 | Hackman | |
| 5,638,300 | A | 6/1997 | Johnson | |
| 5,716,289 | A | 2/1998 | Okoneski | |
| 5,792,000 | A | 8/1998 | Weber et al. | |
| 5,803,823 | A | 9/1998 | Gobush et al. | |
| 5,810,676 | A | 9/1998 | Bird | |
| 5,819,607 | A | 10/1998 | Carnesi | |
| 5,823,878 | A | 10/1998 | Welch | |
| 5,984,804 | A | 11/1999 | Berg | |
| 6,007,431 | A * | 12/1999 | Bloom, Jr. | A63B 53/00 473/292 |
| 6,083,123 | A | 7/2000 | Wood | |
| 6,302,802 | B1 | 10/2001 | Pao | |
| 6,364,787 | B1 | 4/2002 | Huiskamp | |
| 6,441,745 | B1 | 8/2002 | Gates | |
| 6,514,081 | B1 | 2/2003 | Mengoli | |
| 6,572,490 | B2 | 6/2003 | Ashida | |
| 6,626,768 | B2 | 9/2003 | Roelke | |
| 6,889,579 | B1 | 5/2005 | Brown | |
| 6,966,846 | B2 | 11/2005 | Bloom, Jr. | |
| 6,988,968 | B2 | 1/2006 | Okamoto | |
| 7,041,014 | B2 | 5/2006 | Wright et al. | |
| 7,154,100 | B2 | 12/2006 | Spartiotis et al. | |
| 7,171,027 | B2 | 1/2007 | Satoh | |
| 7,195,565 | B2 | 3/2007 | White et al. | |
| 7,219,033 | B2 | 5/2007 | Kolen | |
| 7,261,641 | B2 | 8/2007 | Lindner | |
| 7,264,554 | B2 | 9/2007 | Bentley | |
| 7,264,555 | B2 | 9/2007 | Lee et al. | |
| 7,267,619 | B1 | 9/2007 | Pettis | |
| 7,381,139 | B2 | 6/2008 | Weeks et al. | |
| 7,399,235 | B2 | 7/2008 | Gill et al. | |
| 7,399,236 | B2 | 7/2008 | Takeuchi | |
| 7,458,902 | B2 | 12/2008 | Gill | |
| 7,481,716 | B1 * | 1/2009 | Johnson | A63B 60/24 473/297 |
| 7,500,921 | B2 | 3/2009 | Cheng | |
| 7,545,434 | B2 | 6/2009 | Bean et al. | |
| 7,635,310 | B2 | 12/2009 | Keough | |
| 7,686,701 | B2 | 3/2010 | Hasegawa | |
| 7,693,415 | B2 | 4/2010 | Shiohara | |
| 7,699,718 | B2 * | 4/2010 | Lindner | A63B 53/00 473/297 |
| 7,704,157 | B2 | 4/2010 | Shirai et al. | |
| 7,704,160 | B2 * | 4/2010 | Lindner | A63B 53/00 411/34 |
| 7,704,161 | B2 * | 4/2010 | Lindner | A63B 53/00 473/297 |
| 7,744,480 | B2 | 6/2010 | Gobush | |
| 7,748,298 | B2 | 7/2010 | Brown | |
| 7,798,911 | B2 | 9/2010 | Gill | |
| 7,804,998 | B2 | 9/2010 | Mündermann et al. | |
| 7,870,790 | B2 | 1/2011 | Sato et al. | |
| 7,874,944 | B2 | 1/2011 | LoVine | |
| 7,887,440 | B2 | 2/2011 | Wright et al. | |
| 7,909,705 | B2 | 3/2011 | Gill et al. | |
| 7,992,470 | B2 | 8/2011 | Brown | |
| 7,997,997 | B2 | 8/2011 | Bennett et al. | |
| 8,118,687 | B1 | 2/2012 | Galloway | |
| 8,150,248 | B1 | 4/2012 | Woodman | |
| 8,177,658 | B1 * | 5/2012 | Johnson | A63B 60/24 473/297 |
| 8,216,085 | B2 | 7/2012 | Fujimoto | |
| 8,221,257 | B2 | 7/2012 | Davenport | |
| 8,257,191 | B2 | 9/2012 | Stites et al. | |
| 8,313,392 | B2 | 11/2012 | White | |
| 8,335,669 | B2 | 12/2012 | Shimizu et al. | |
| 8,402,863 | B2 | 3/2013 | Brown | |
| 8,444,502 | B2 | 5/2013 | Karube | |
| 8,475,300 | B2 | 7/2013 | Ueda | |
| 8,491,408 | B2 * | 7/2013 | Beach | A63B 53/10 473/296 |
| 8,556,267 | B2 | 10/2013 | Gobush | |
| 8,595,312 | B2 | 11/2013 | Robles Gil Daellenbach et al. | |
| 8,636,605 | B2 | 1/2014 | Rose | |
| 8,657,707 | B2 | 2/2014 | Ueda et al. | |
| 8,668,595 | B2 | 3/2014 | Boyd et al. | |
| 2002/0173364 | A1 | 11/2002 | Boscha | |
| 2003/0109335 | A1 | 6/2003 | Dineen et al. | |
| 2004/0138000 | A1 | 7/2004 | Braly et al. | |
| 2005/0054459 | A1 | 3/2005 | Oldenburg | |
| 2006/0084516 | A1 | 4/2006 | Eyestone et al. | |
| 2006/0166737 | A1 | 7/2006 | Bentley | |
| 2012/0052973 | A1 | 3/2012 | Bentley | |
| 2012/0100923 | A1 | 4/2012 | Davenport | |
| 2012/0157241 | A1 | 6/2012 | Nomura et al. | |
| 2012/0214606 | A1 | 8/2012 | Ueda | |
| 2012/0277016 | A1 | 11/2012 | Boyd et al. | |
| 2012/0277017 | A1 | 11/2012 | Boyd et al. | |
| 2012/0277018 | A1 | 11/2012 | Boyd et al. | |
| 2012/0286114 | A1 | 11/2012 | Jertson et al. | |
| 2012/0289354 | A1 | 11/2012 | Cottam et al. | |
| 2012/0302364 | A1 | 11/2012 | Boccieri | |
| 2013/0041590 | A1 | 2/2013 | Burich et al. | |
| 2013/0143687 | A1 | 6/2013 | Stafford | |
| 2013/0165249 | A1 * | 6/2013 | Margoles | A63B 53/145 473/297 |
| 2013/0213185 | A1 | 8/2013 | Brown | |
| 2013/0344973 | A1 | 12/2013 | Margoles et al. | |

* cited by examiner

GOLF CLUB WITH IMPROVED WEIGHT DISTRIBUTION

CROSS-REFERENCE TO RELATED APPLICATION

The present application is a Continuation in Part of U.S. patent application Ser. No. 14/214,025, filed Mar. 14, 2014, the disclosure of which is hereby incorporated by reference in its entirety.

TECHNICAL FIELD

The present technology generally relates to systems, devices, and methods related to golf clubs, and more specifically to golf clubs with improved weight distribution.

DESCRIPTION OF THE RELATED TECHNOLOGY

In order to create golf clubs that help the golfer achieve a better score, golf club designers have made numerous technological advancements in creating a golf club that is easier to hit. Technological advances such as metalwood drivers, cavity back irons, and even graphite shafts have all made the game of golf much easier for the average golfer by helping them hit the golf ball longer and straighter. However, despite all the technical advancements in the game of golf, the biggest variation in a golf swing is often produced by the golfer himself or herself. In fact, a golf swing is so unique to each individual golfer, it can be argued that no two golfers have identical golf swings.

In order to address the often diverging needs of the different swings associated with different golfers, golf club designers make different models of golf clubs that have different performance characteristics to help golfers get more performance out of their particular golf swing. More specifically, golf club designers often create different models of golf club heads having different size, shape, and geometry, allowing various golfers to select from the model that suits their game the most. Similarly, golf club shaft designers often create different models of golf club shafts having different weight, flex, and materials to provide the golfer even more variety to truly allow a golfer to select what works best for his or her golf swing. Additionally, some manufacturers have incorporated weight members inside the grip end of the shaft to alter the weight distribution and feel of the golf club to suit the swing of the golfer.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that many golfers can benefit from a weight member strategically placed in the grip end of the shaft to optimize their swing. Thus, there exists a need for an adjustable weight member system and method of strategically selecting the position and mass of an optimal weight member to suit each golfer's swing. The present technology is directed to measuring a golfer's swing and altering the weight distribution of one or more of their golf clubs to minimize the dispersion distance of their golf shots. More specifically, some embodiments relate to a fitting system designed to recommend a preferred weight distribution for a golfer's clubs. Some embodiments relate to systems, devices, and methods for altering the weight distribution of a golf club.

One non-limiting embodiment of the present technology includes a method of optimizing a weight distribution of a golf club for a golfer's swing, comprising monitoring one or more dynamic behavioral characteristics of said golfer's swing, measuring a dispersion distance for at least one golf ball struck towards a target by said golfer using said golfer's swing, wherein a target line comprises a line extending between said golf ball at address and said target, wherein said dispersion distance is defined as a distance from said target line, measured perpendicularly from said target line to a point at which said golf ball comes to rest after being struck by said golfer using said golfer's swing, and altering said weight distribution of said golf club to minimize said dispersion distance.

An additional non-limiting embodiment of the present technology includes monitoring one or more dynamic behavioral characteristics comprises monitoring a rotation angle of said golfer's swing through a measurement portion of said golfer's swing, wherein said target line is parallel to a ground plane, wherein a rotation reference plane is oriented parallel to said target line and perpendicular to said ground plane, and wherein said rotation angle is defined as the relative angle between a grip portion of a golf club being swung by said golfer and said rotation reference plane, said rotation angle measured about an axis perpendicular to said ground plane.

An additional non-limiting embodiment of the present technology includes monitoring one or more dynamic behavioral characteristics comprises monitoring a grip-ball offset through a measurement portion of said golfer's swing, wherein said golf club being swung by said golfer comprises a club reference point, said club reference point defined as a point approximately 5.25 inches from a proximal end of said golf club along a centerline of said golf club, wherein said grip-ball offset is defined as a distance measured along an axis parallel to said target line from said club reference point to the center of said golf ball.

An additional non-limiting embodiment of the present technology includes calculating a rotation offset ratio of said golfer's swing, wherein said rotation offset ratio is defined as the slope of a straight line fit to a plot of rotation angle vs. grip-ball offset over said measurement portion of said golfer's swing.

In an additional non-limiting embodiment of the present technology includes said measurement portion of said golfer's swing begins at a downswing grip horizontal position and ends at an impact position, wherein said downswing grip horizontal position is defined as the instant during a downswing portion of said golfer's swing wherein said grip portion of said golf club is parallel to said ground plane, and wherein said impact position is defined as the instant during said golfer's swing wherein said golf club being swung by said golfer strikes said golf ball.

An additional non-limiting embodiment of the present technology includes altering said weight distribution of said golf club comprises comparing said rotation offset ratio of said golfer's swing to said dispersion distance resulting from said golfer's swing striking said golf ball and installing a weight member into said golf club.

An additional non-limiting embodiment of the present technology includes altering said weight distribution of said golf club further comprises selecting a weight member from a set of interchangeable weight members, said set of interchangeable weight members comprising a proximal weight member and a distal weight member, said proximal weight member distinct and separate from said distal weight member.

In an additional non-limiting embodiment of the present technology said proximal weight member comprises a heavy weighted portion, wherein said heavy weighted portion of said proximal weight member is located proximally from said club reference point when installed in said golf club, wherein said distal weight member comprises a heavy weighted portion, wherein said heavy weighted portion of said distal weight member is located distally from said club reference point when installed in said golf club.

In an additional non-limiting embodiment of the present technology said golf club comprises a weight receiving grip at a proximal end of a shaft, wherein altering said weight distribution of said golf club comprises expanding a proximal portion of said weight receiving grip with a grip expansion tool and installing a weight member in said weight receiving grip.

An additional non-limiting embodiment of the present technology includes a method of optimizing a weight distribution of a golf club for a golfer's swing, comprising monitoring one or more dynamic behavioral characteristics of said golfer's swing, altering said weight distribution of said golf club to optimize said golfer's swing, wherein altering said weight distribution of said golf club comprises evaluating said one or more dynamic behavioral characteristics of said golfer's swing, selecting a weight member from a set of interchangeable weight members, and installing said weight member into said golf club.

In an additional non-limiting embodiment of the present technology said set of interchangeable weight members comprises a proximal weight member and a distal weight member.

In an additional non-limiting embodiment of the present technology said golf club comprises a shaft, a grip affixed to a proximal portion of said shaft, and a club head affixed to a distal portion of said shaft, wherein said golf club comprises a club reference point, said club reference point comprising a point approximately 5.25 inches from a proximal end of said golf club along a centerline of said golf club, wherein said proximal weight member comprises a heavy weighted portion, wherein said heavy weighted portion of said proximal weight member is located proximally from said club reference point when installed in said golf club, wherein said distal weight member comprises a heavy weighted portion, wherein said heavy weighted portion of said distal weight member is located distally from said club reference point when installed in said golf club.

In an additional non-limiting embodiment of the present technology said heavy weighted portion of said proximal weight member is located immediately adjacent a proximal end of said golf club when installed in said golf club and wherein said heavy weighted portion of said distal weight member is offset distally from said proximal end of said golf club when installed in said golf club.

In an additional non-limiting embodiment of the present technology said set of interchangeable weight members further comprises an unweighted cap, wherein said unweighted cap comprises a mass less than approximately 5 grams.

In an additional non-limiting embodiment of the present technology said club comprises a weight receiving grip at a proximal end of a shaft, wherein altering said weight distribution of said golf club comprises expanding a proximal portion of said weight receiving grip with a grip expansion tool and installing said weight member in said weight receiving grip.

An additional non-limiting embodiment of the present technology includes a system for optimizing weight distribution of a golf club, comprising a weight receiving grip, said weight receiving grip configured to be affixed to a proximal end of a golf club shaft, wherein said weight receiving grip comprises a generally tubular member comprising a shaft bore configured to surround a proximal portion of said shaft, wherein said weight receiving grip comprises a weight retention portion at a proximal end of said weight receiving grip, said weight retention portion configured to engage a weight member, a proximal weight member comprising a grip coupling portion and a heavy weighted portion, said proximal weight member configured to be installed within said weight receiving grip, said grip coupling portion configured to engage said weight retention portion of said weight receiving grip, said heavy weighted portion adjacent a distal end of said grip coupling portion, said heavy weighted portion of said proximal weight member located adjacent said grip coupling portion of said proximal weight member, a distal weight member comprising a grip coupling portion and a heavy weighted portion, said distal weight member configured to be installed within said weight receiving grip, said grip coupling portion configured to engage said weight retention portion of said weight receiving grip, said heavy weighted portion offset distally from said grip coupling portion of said distal weight member, said heavy weighted portion of said distal weight member offset at least 5 inches distally from said grip coupling portion of said distal weight member, and a grip expanding tool configured to deflect a portion of said weight receiving grip facilitating installation or removal of said weight members from said weight receiving grip.

In an additional non-limiting embodiment of the present technology said weight retention portion of said weight receiving grip comprises a cavity formed in an internal surface of said weight receiving grip, wherein said weight retention portion of said weight receiving grip comprises a weight retention lip proximal said cavity, said weight retention lip configured to limit said distal weight member and said proximal weight member from dislodging from said weight receiving grip, wherein said grip coupling portion of said proximal weight member and said grip coupling portion of said distal weight member each comprise a grip engaging member, said grip engaging members each configured to reside within said cavity of said weight receiving grip.

In an additional non-limiting embodiment of the present technology said weight retention lip comprises a bore comprising an inner diameter, wherein said grip engaging member comprises an outer diameter, wherein said outer diameter of said grip engaging member is larger than said inner diameter of said bore of said weight retention lip, wherein said grip expanding tool is configured to deform said weight retention portion of said grip and expand said inner diameter of said bore of said weight retention lip larger than said outer diameter of said grip engaging member, allowing said grip engaging member to pass through said bore of said weight retention lip.

In an additional non-limiting embodiment of the present technology said grip expansion tool comprises a first member, a second member, and a plurality of expansion members, said first member rotatably coupled to said second member, wherein forcing a portion of said first member towards a portion of said second member causes said first member to rotate relative to said second member, wherein said grip expansion tool comprises a weight insertion port, wherein said plurality of expansion members are configured to translate relative to said first member and said second member as said first member rotates relative to said second member, wherein said plurality of expansion members are configured to engage and expand said inner diameter of said bore of said weight retention lip of said weight receiving grip, allowing said grip engaging member to pass through said weight insertion port and said bore of said weight retention lip.

In an additional non-limiting embodiment of the present technology said grip expansion tool comprises a first member, a second member, and a plurality of weight members, wherein said first member is rotatably coupled to said second member, wherein said plurality of expansion members are configured to engage said weight retention portion of said grip and define a weight insertion port, and wherein said plurality of expansion members are movably coupled to said first member and said second member such that relative motion of said first member relative to said second member alters the relative position of the plurality of expansion members such that the size of the weight insertion port changes, thereby allowing said grip engaging member to pass through said weight insertion port and into said weight retention portion of said grip.

One non-limiting embodiment of the present technology includes a weight member for optimizing weight distribution of a golf club, comprising a removable weight member configured to reside within a shaft of said golf club; said shaft having a proximal end and a distal end, said proximal end opposite a head of said golf club, said distal end adjacent said head of said golf club; said weight member comprising a heavy weighted portion; said heavy weighted portion offset distally from said proximal end of said shaft; said weight member comprising a plurality of locating members; said plurality of locating members configured to limit movement of said heavy weighted portion relative to an inner wall of said shaft.

In an additional non-limiting embodiment of the present technology at least one of said plurality of locating members is located at a proximal end of said heavy weighted portion and at least one of said plurality of locating members is located at a distal end of said heavy weighted portion.

In an additional non-limiting embodiment of the present technology said weight member comprises a grip coupling portion configured to engage a grip of said golf club, wherein said grip coupling portion comprises a grip engaging member, said grip engaging member configured to reside within a cavity formed in said grip.

In an additional non-limiting embodiment of the present technology said weight member further comprises a weight rod, said weight rod configured to affix said heavy weighted portion to said grip coupling portion.

In an additional non-limiting embodiment of the present technology said heavy weighted portion is offset distally from said grip coupling portion of said distal weight member at least 5 inches.

In an additional non-limiting embodiment of the present technology said weight member further comprises a rod weight coupling member, said rod weight coupling member configured to couple said weight rod to said heavy weighted portion, said rod weight coupling member configured to retain one of said plurality of locating members.

In an additional non-limiting embodiment of the present technology said rod weight coupling member comprises a threaded portion configured to engage a threaded portion of said heavy weighted portion.

In an additional non-limiting embodiment of the present technology each of said plurality of locating members comprises a central bore, said threaded portion of said weight rod coupling member configured to pass through said central bore of one of said plurality of locating members.

In an additional non-limiting embodiment of the present technology each of said plurality of locating members comprises a plurality of engaging arms extending outwards from said heavy weighted portion.

In an additional non-limiting embodiment of the present technology each of said plurality of locating members comprises relief slots between each of said engaging arms.

In an additional non-limiting embodiment of the present technology said plurality of locating members comprise a three dimensional geometry wherein each of said engaging arms are angled upwards towards said proximal end of said shaft.

In an additional non-limiting embodiment of the present technology said plurality of locating members are deformable, allowing said plurality of locating members to adapt to a variety of shafts having different internal diameters as well as shafts with tapered internal diameters.

One non-limiting embodiment of the present technology includes a removable weight member configured to reside within a shaft of said golf club; said shaft having a proximal end and a distal end, said proximal end opposite a head of said golf club, said distal end adjacent said head of said golf club; said weight member comprising a heavy weighted portion; said heavy weighted portion offset distally from said proximal end of said shaft; said weight member comprising a locating member; wherein said locating member comprises a plurality of engaging arms extending outwards from said heavy weighted portion; wherein said locating member is deformable, allowing said locating member to adapt to a variety of shafts having different internal diameters as well as shafts with tapered internal diameters; wherein said locating member is configured to limit movement of said heavy weighted portion relative to an inner wall of said shaft.

In an additional non-limiting embodiment of the present technology said weight member comprises a grip coupling portion configured to engage a grip of said golf club, wherein said grip coupling portion comprises a grip engaging member, said grip engaging member configured to reside within a cavity formed in said grip.

In an additional non-limiting embodiment of the present technology said weight member further comprises a weight rod, said weight rod configured to affix said heavy weighted portion to said grip coupling portion.

In an additional non-limiting embodiment of the present technology said heavy weighted portion is offset distally from said grip coupling portion of said distal weight member at least 5 inches.

In an additional non-limiting embodiment of the present technology said weight member further comprises a rod weight coupling member, said rod weight coupling member configured to couple said weight rod to said heavy weighted portion, said rod weight coupling member configured to retain said locating member.

In an additional non-limiting embodiment of the present technology said rod weight coupling member comprises a threaded portion configured to engage a threaded portion of said heavy weighted portion.

In an additional non-limiting embodiment of the present technology said locating member comprises a central bore, said threaded portion of said weight rod coupling member configured to pass through said central bore of said locating member.

In an additional non-limiting embodiment of the present technology said plurality of locating members comprises relief slots between each of said engaging arms, wherein locating member comprises a three dimensional geometry wherein each of said engaging arms are angled upwards towards said proximal end of said shaft.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
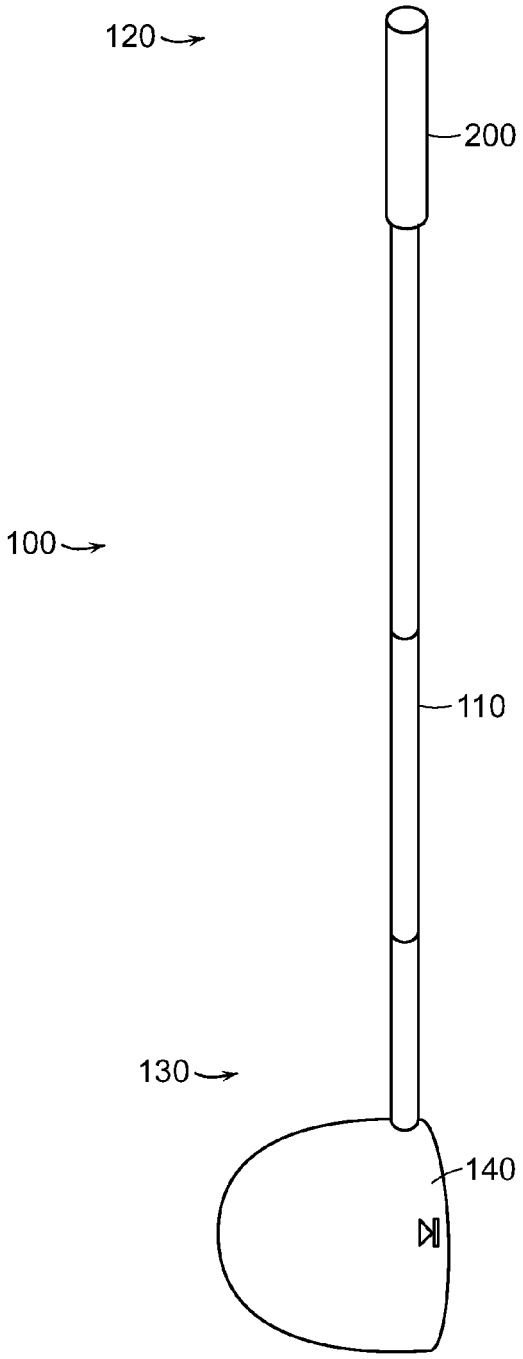
FIG. 1 illustrates a perspective view of a golf club.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Figure 2:
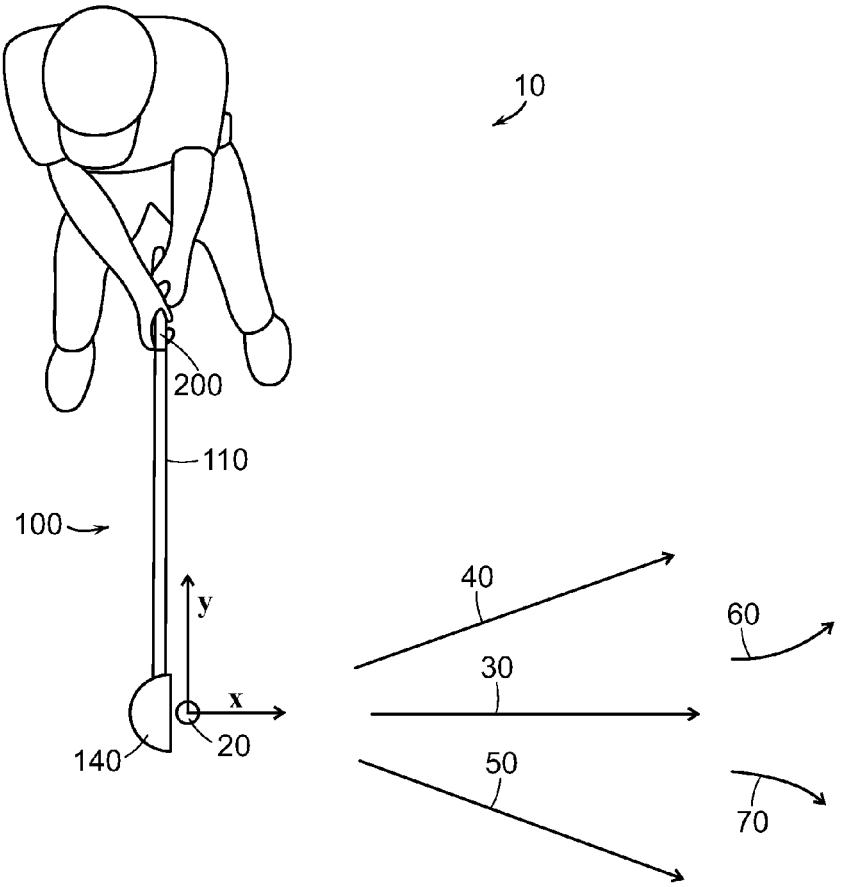
FIG. 2 illustrates a top view of a right handed golfer holding a golf club at address adjacent a golf ball.
Figure 3:
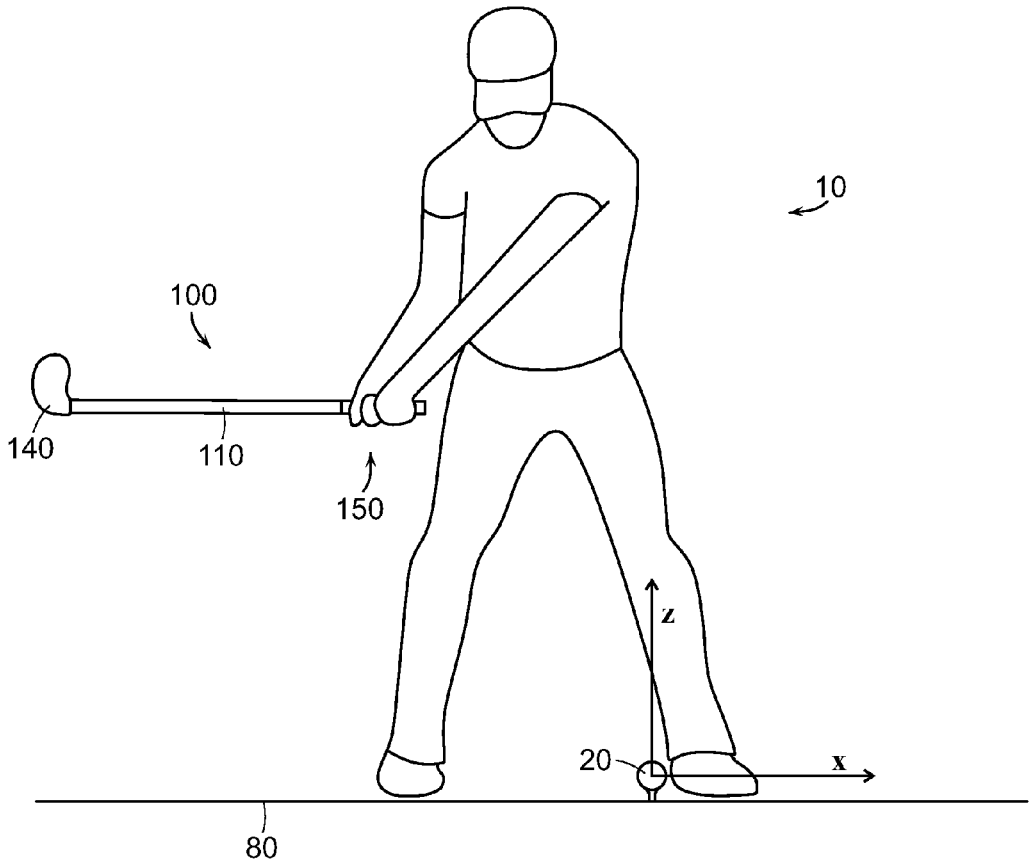
FIG. 3 illustrates a front view of a golf swing at a downswing grip horizontal position.

FIG. 1 illustrates a perspective view of a golf club 100. The golf club 100 can include a shaft 110, a grip 200 located at the proximal end 120 of the shaft 110 and a club head 140 located at the distal end 130 of the shaft 110. FIG. 2 illustrates a top view of a right handed golfer 10 holding a golf club 100 at address adjacent a golf ball 20. FIG. 2 also illustrates a coordinate system centered on the golf ball 20 including an x-axis and a y-axis. The x-axis is oriented down the target line 30. The target line 30 is defined as a line drawn between the ball 20 and the target at which the golfer 10 is aiming. The y-axis is perpendicular to the x-axis and is oriented towards the golfer 10. The x-axis and y-axis form a reference plane parallel to the ground plane 80 and offset above the ground plane 80 equal to the distance the center of the golf ball 20 is above the ground plane 80, as illustrated in FIG. 3. The coordinate system also includes a z-axis perpendicular to both the x-axis and y-axis.

As illustrated in FIG. 2, when a golfer 10 strikes a golf ball 20 with the head 140 of the golf club 100 the initial trajectory of the golf ball 20 can be along the target line 30, it can be a pull 40 (left of the target line 30 for a right handed golfer 10), or it can be a push 50 (right of the target line 30 for a right handed golfer 10). Unless noted otherwise, all descriptions of ball flight herein refer to ball 20 struck by a right handed golfer 10. For a left handed golfer, a pull would be right of the target line 30 and a push would be left of the target line 30. A ball 20 hit along the target line 30 incorporates an x component in its initial trajectory and an insubstantial y component. The initial trajectory of a pull 40 or push 50 each incorporate both an x component and a y component. The launch angle, and thus the z component of the trajectory, does not affect the classification of the ball flight as along the target line 30, a pull 40, or a push 50.

Additionally, as illustrated in FIG. 2, the flight of the golf ball 20 can be classified as a draw 60, where the flight of the ball curves left from the initial trajectory due to side spin, or a fade 70, where the flight of the ball curves right from the initial trajectory due to side spin. For a left handed golfer, a draw would curve right and a fade would curve left. Again, the launch angle, and thus the z component of the ball path and curve, does not affect the classification of the ball flight as a draw 60 or a fade 70.

Additionally, a ball's flight can be classified using both the initial trajectory of the ball's flight as well as the curve of the ball's flight. For example, a shot which has an initial trajectory left of the target line 30, and subsequently curves left, can be classified as a pull-draw. A shot which has an initial trajectory right of the target line 30, and subsequently curves right, can be classified and a push-fade. In some instances, the face angle of the club head 140 as it impacts the ball 20 can affect the flight of the ball. A neutral face, assuming a neutral swing path, will generally create a straight ball flight down the target line 30. A closed face can cause a pull 40, a draw 60, or a pull-draw. An open face can cause a push 50, a fade 70, or a push-fade. Additionally, other characteristics of a golfer's swing can affect the flight of the ball which may include, for example, swing path, swing speed, attack angle, impact location on the face, etc. Generally, a ball flight which deviates either left or right from the target line 30 will land and subsequently roll left or right of the intended target to a final resting location. The distance left or right of the target line 30 at which the ball 20 comes to rest is defined as the dispersion distance. For a right handed golfer 10, the dispersion distance is positive for a ball 20 coming to rest left of the target line 30 and negative for a ball 20 coming to rest right of the target line 30.

Embodiments described herein generally relate to systems, devices, and methods related to a weight member 300 strategically placed in the grip end of the shaft 110 to optimize their swing. Some embodiments comprise an adjustable weight member system and method of strategically selecting the position and mass of an optimal weight member to suit each golfer's swing. Some embodiments are directed to a system of measuring a golfer's swing and altering the weight distribution of one or more of their golf clubs to minimize the dispersion distance of their golf shots. Some embodiments are directed to a system of measuring a golfer's swing and altering the weight distribution of one or more of their golf clubs to manipulate the flight path of their golf shots. In some embodiments, dispersion distance can refer to the average dispersion distance over a plurality of shots as many golfers cannot hit exactly the same shot repeatedly. More specifically, some embodiments relate to a fitting system designed to recommend a preferred weight distribution for a golfer's clubs.

Figure 4:
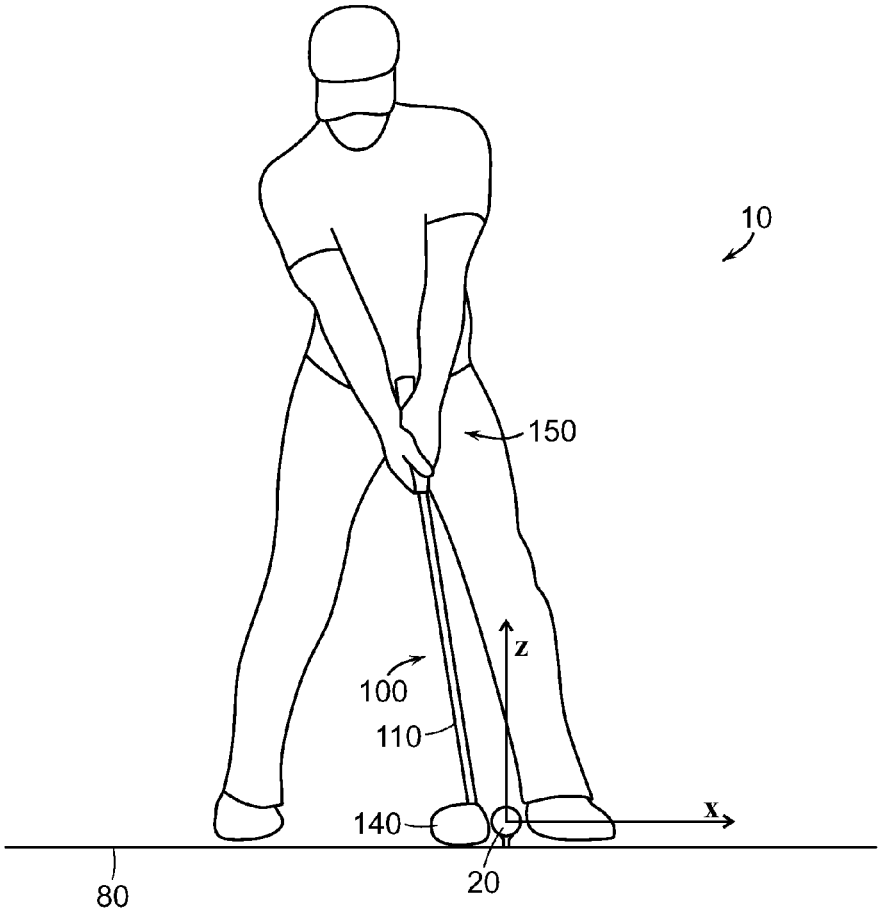
FIG. 4 illustrates a front view of a golf swing at impact.

In some embodiments, a golfer 10 can go through a fitting process which measures various dynamic behavioral characteristics of their swing. More details regarding the composition, operation, and usage of such a fitting system may be found in commonly owned U.S. patent application Ser. No. 13/863,596 to Margoles et al., Fitting System for a Golf Club, filed on Apr. 16, 2013, the disclosure of which is incorporated by reference in its entirety. In addition to the dynamic behavioral characteristics described in the Margoles application, certain dynamic behavioral characteristics of a golfer's swing can be particularly useful in predicting the effect of altering the weight distribution of a golf club 100 on a golfer's dispersion distance. FIG. 3 illustrates a front view of a golf swing at a position which we shall refer to as "downswing grip horizontal." The downswing grip horizontal position is defined by the instant during the downswing that the grip portion 150 of the golf club 100 is parallel to the reference plane formed by the x-axis and y-axis, and thus parallel to the ground plane 80. FIG. 4 illustrates a front view of a golf swing at a position which we shall refer to as "impact." The impact position is defined by the instant during the swing that the club head 140 of the golf club 100 strikes the golf ball 20. The grip portion 150 of the golf club 100 refers to the most proximal portion of the golf club 100 and is approximately 12 inches long.

In some embodiments, dynamic behavioral characteristics of a golf swing can be measured during the portion of the swing between the downswing grip horizontal position and the impact position. In other embodiments, the endpoints of the measurement may differ from those described above. For example, in one embodiment the measurement could begin at a different portion of the swing where the grip portion 150 of the golf club 100 is angled relative to the reference plane. In another embodiment the measurement could end at a different portion of the swing other than the instant that the golf club head 140 strikes the golf ball 20.

Figure 5:
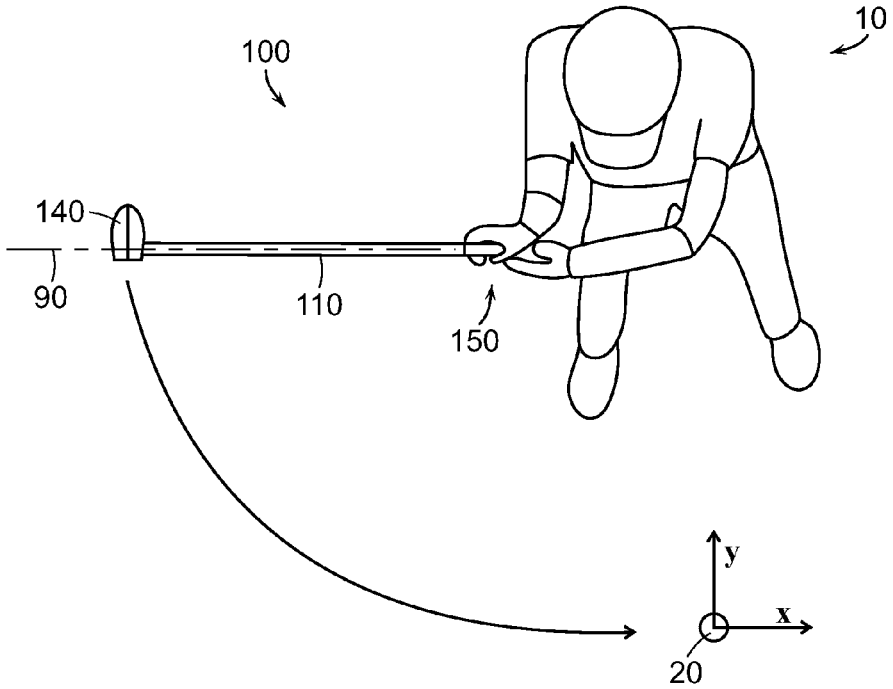
FIG. 5 illustrates a top view of a golf swing at the downswing grip horizontal position.
Figure 6:
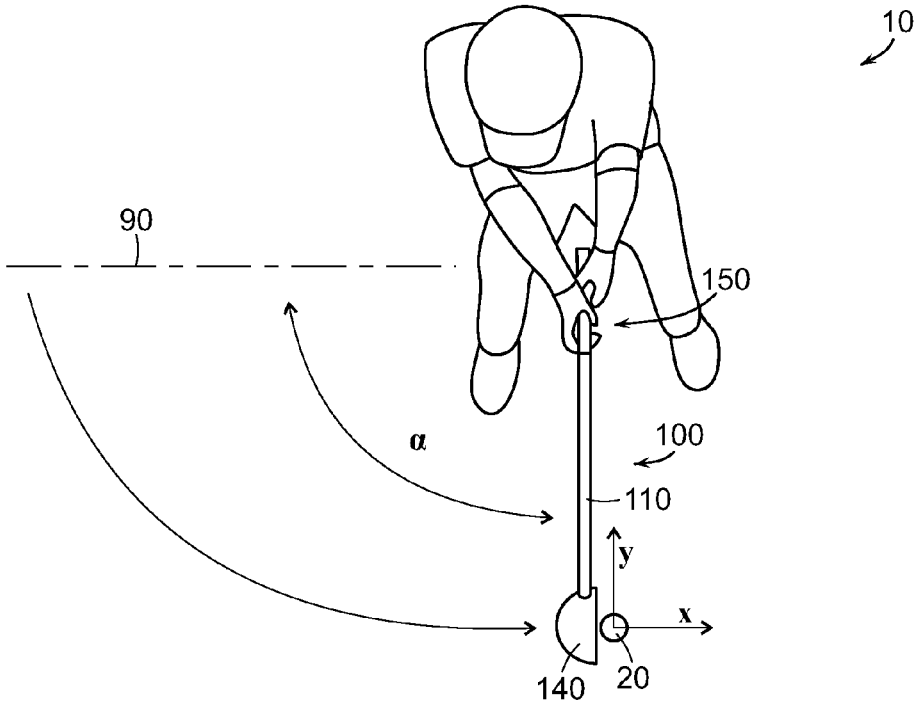
FIG. 6 illustrates a top view of a golf swing at the impact position.

FIG. 5 illustrates a top view of a golf swing at the downswing grip horizontal position. FIG. 6 illustrates a top view of a golf swing at the impact position. FIGS. 5 and 6 include a rotation reference plane 90 which is parallel to a plane formed by the x-axis and z-axis. As the golfer 10 progresses through their swing from downswing grip horizontal to impact, the fitting system can monitor the relative angle between the grip portion 150 of the golf club 100 and the rotation reference plane 90 about an axis parallel to the z-axis, which is referred to herein as the rotation angle $\alpha$. The rotation angle $\alpha$ is measured from the rotation reference plane 90 in a counterclockwise direction. The rotation angle $\alpha$ of the swing at downswing grip horizontal illustrated in FIG. 5 is approximately 0 degrees where the grip portion 150 of the golf club 100 is substantially parallel to the rotation reference plane 90. A different swing, not illustrated, may incorporate a non-zero rotation angle $\alpha$ at the downswing grip horizontal portion of a golfer's swing. In some swings, the grip portion 150 of the golf club 100 can be angled clockwise relative to the rotation reference plane 90 at downswing grip horizontal resulting in a negative rotation angle $\alpha$. In some swings, the grip portion 150 of the golf club 100 can be angled counterclockwise relative to the rotation reference plane 90 at downswing grip horizontal resulting in a positive rotation angle $\alpha$. In FIG. 6, the rotation angle $\alpha$ of the swing at impact is approximately 90 degrees. A different swing may incorporate a rotation angle $\alpha$ above or below 90 degrees at impact. A golfer who leads more with their hands, for example, may have a rotation angle $\alpha$ below 90 degrees at impact.

Figure 7:
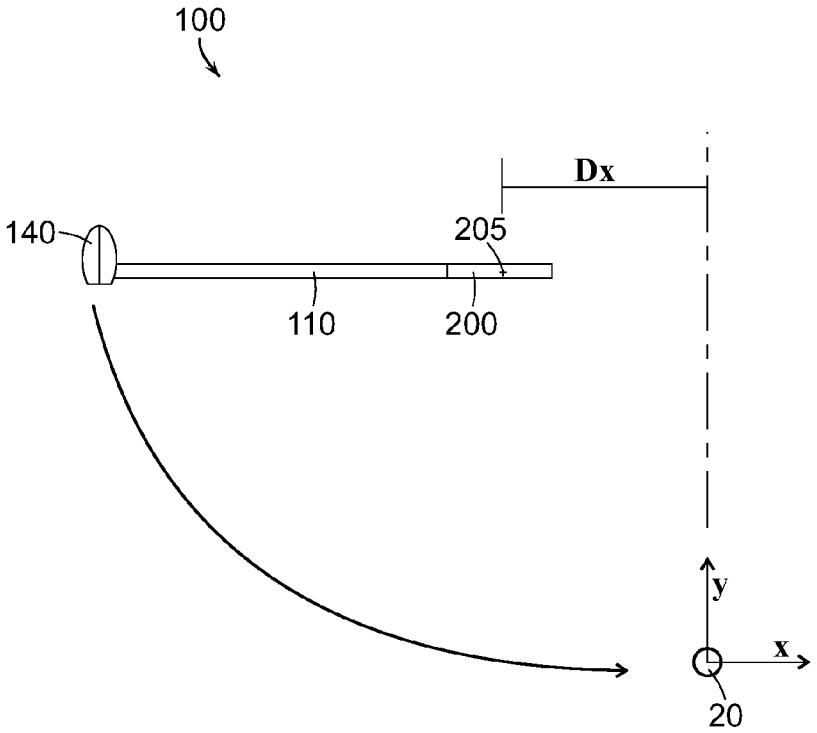
FIG. 7 illustrates a top view of the golf swing of FIG. 5 at downswing grip horizontal, omitting the golfer for simplification.
Figure 8:
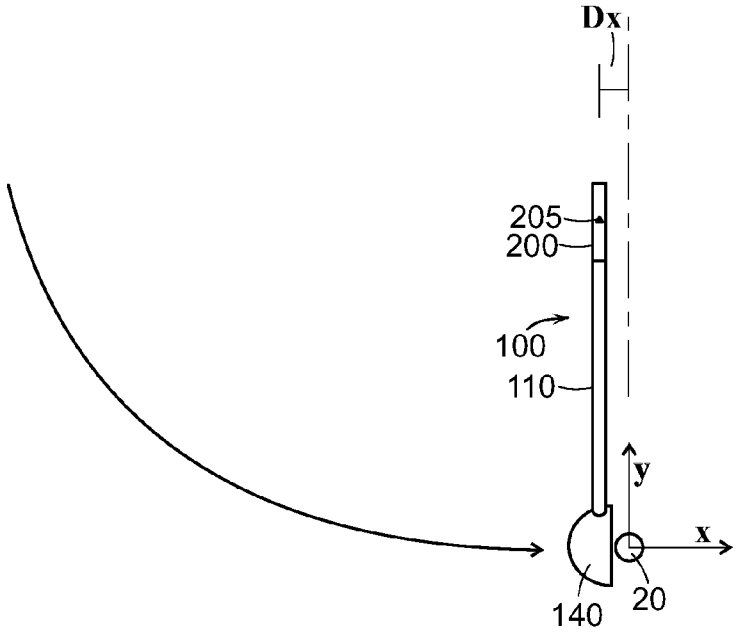
FIG. 8 illustrates a top view of the golf swing of FIG. 6 at impact, omitting the golfer for simplification.

FIG. 7 illustrates a top view of the golf swing of FIG. 5 at downswing grip horizontal, omitting the golfer 10 for simplification. FIG. 8 illustrates a top view of the golf swing of FIG. 6 at impact, omitting the golfer 10 for simplification. The grip of the golf club 100 illustrated in FIGS. 7 and 8 includes a club reference point 205, which is defined as a point 5.25 inches from the proximal end 120 of the golf club 100 along the golf club's centerline. FIGS. 7 and 8 each also illustrate the grip-ball offset Dx, which is defined as the distance along the x-axis the club reference point 205 is offset from the center of the golf ball 20. Any measurement of the grip-ball offset Dx wherein the grip is behind the golf ball 20 results in a negative grip-ball offset Dx and any measurement of the grip-ball offset Dx wherein the grip is in front of the golf ball 20 results in a positive grip-ball offset Dx. As the golfer 10 progresses through their swing from downswing grip horizontal to impact, the fitting system can monitor the grip-ball offset Dx. The grip ball 20 offset illustrated in FIG. 7 is approximately −0.31 meters. A different swing may incorporate a different grip-ball offset Dx at downswing grip horizontal, which for example, may be more or less than −0.31 meters. The grip ball 20 offset illustrated in FIG. 8 is approximately −0.01 meters. A different swing may incorporate a different grip-ball offset Dx at impact, which for example, may be more or less than −0.01 meters.

Figure 9:
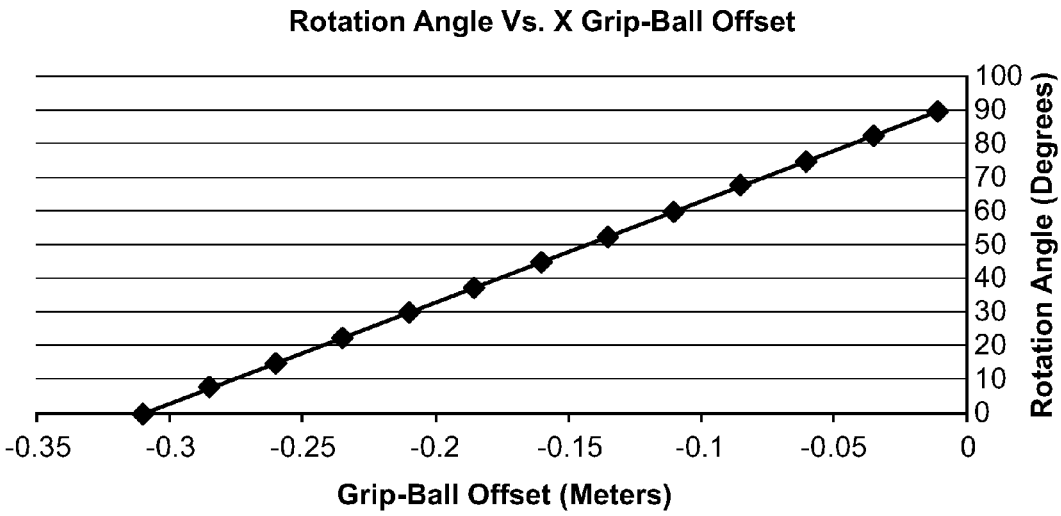
FIG. 9 includes a graph plotting rotation angle vs. grip-ball offset for the golf swing illustrated in FIGS. 5-8 at a plurality of points between downswing grip horizontal and impact.

In some embodiments, the fitting system can utilize a single dynamic behavioral characteristic of a golf swing to aid in the recommendation for altering the weight distribution of one or more of a golfer's clubs. In some embodiments, the fitting system can utilize a combination of dynamic behavioral characteristics of a golf swing to aid in the recommendation for altering the weight distribution of one or more of a golfer's clubs. In some embodiments, the dynamic behavioral characteristics can include for example, the relationship between rotation angle $\alpha$ and grip-ball offset Dx for a golfer's swing. FIG. 9 includes a graph plotting rotation angle $\alpha$ vs. grip-ball offset Dx for the golf swing illustrated in FIGS. 5-8 at a plurality of points between downswing grip horizontal and impact. Fitting a straight line to the plurality of points and calculating the slope of that line yields an additional dynamic behavioral characteristic, the rotation offset ratio, a ratio which can be helpful in the recommendation for altering the weight distribution of one or more of a golfer's clubs. The rotation offset ratio of the golf swing illustrated in FIGS. 5-9 is approximately 300 Degrees/Meter.

Figure 10:
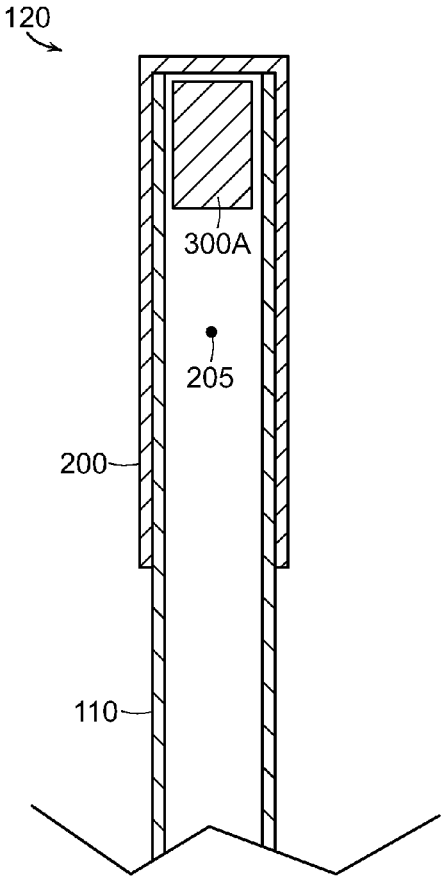
FIG. 10 illustrates a cross sectional view of a proximal portion of a golf club incorporating a proximal weight member.
Figure 11:
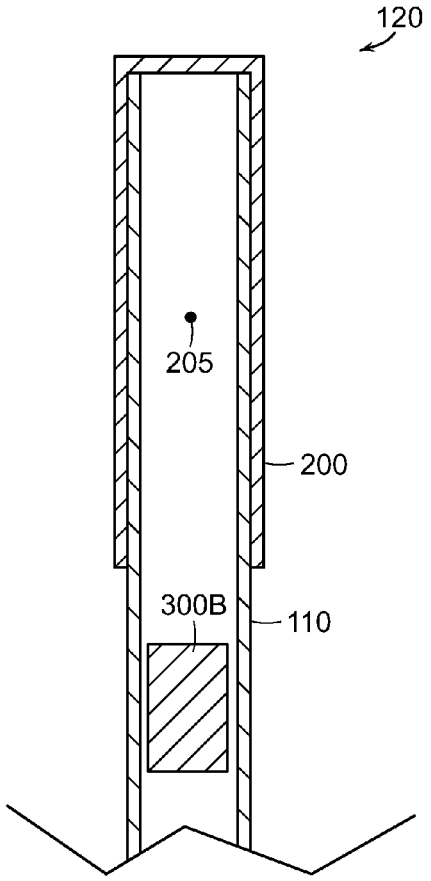
FIG. 11 illustrates a cross sectional view of a proximal portion of a golf club incorporating a distal weight member.

FIG. 10 illustrates a cross sectional view of a proximal portion of a golf club 100 incorporating a proximal weight member 300A. In some embodiments, as illustrated in FIG. 10, the golf club 100 can include a proximal weight member 300A located immediately adjacent the proximal end 120 of the golf club 100. The proximal weight member 300A can alter the weight distribution of the golf club 100. FIG. 11 illustrates a cross sectional view of a proximal portion of a golf club 100 incorporating a distal weight member 300B. In some embodiments, as illustrated in FIG. 11, the golf club 100 can include a distal weight member 300B offset distally from the proximal end 120 of the golf club 100. In some embodiments, as illustrated in FIG. 11, the distal weight member 300B can be offset from the proximal end 120 of the golf club 100 such that the distal weight member 300B is located distally of the club reference point 205.

Figure 12:
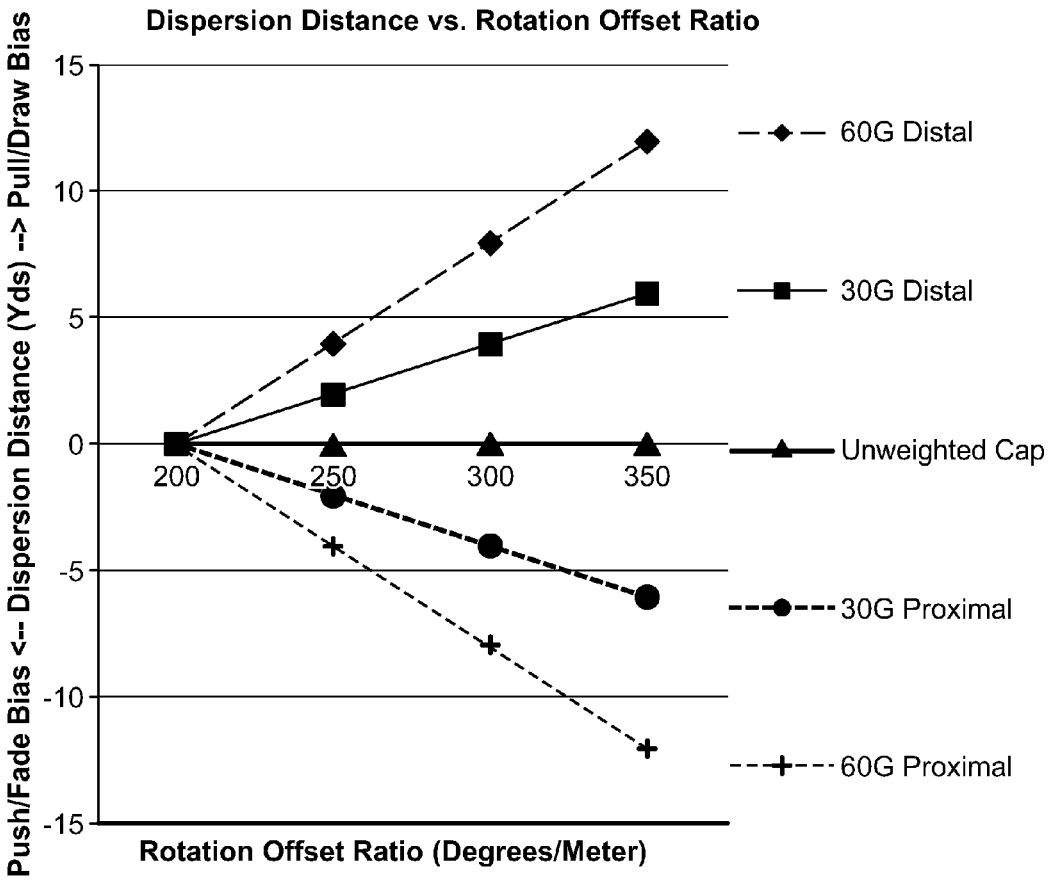
FIG. 12 includes a graph plotting dispersion vs. rotation offset ratio.
Figure 23:
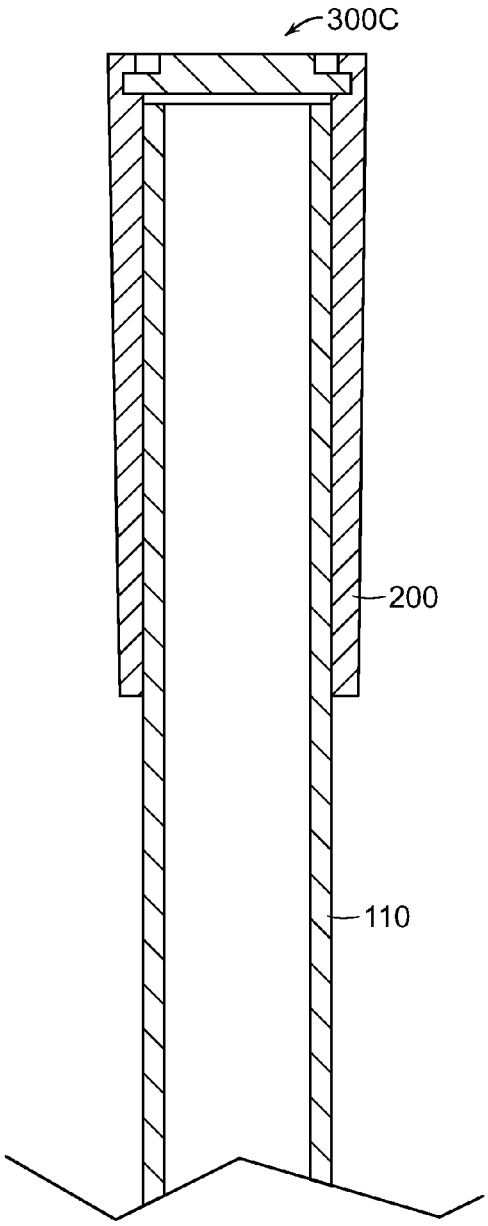
FIG. 23 illustrates a cross sectional view of one embodiment of an unweighted cap installed in a grip.

FIG. 12 includes a graph plotting dispersion distance vs. rotation offset ratio. The graph illustrates the expected change in dispersion distance for golfers having particular rotation offset ratios utilizing a variety of distal and proximal weight members relative to a golf club utilizing an unweighted cap 300C, as illustrated in FIG. 23, which emulates a standard golf club not utilizing improved weight distribution as described herein. The relationships illustrated in FIG. 12 were developed through extensive testing of over 100 golfers of varying ability, technique, swing speed, etc., utilizing the fitting system described in the Margoles application. Testing showed a statistically significant trend that for a right handed golfer, a proximal weight member 300A tends to alter ball flight such that the ball 20 comes to rest to the right of a shot hit by an otherwise identical golf club 100 not incorporating a proximal weight member 300A or distal weight member 300B, and that a distal weight member 300B tends to alter ball flight such that the ball 20 comes to rest to the left of a shot hit by an otherwise identical golf club 100 not incorporating a proximal weight member 300A or distal weight member 300B. Testing also showed that by increasing the mass of the proximal weight member 300A or distal weight member 300B, the effect of the proximal weight member 300A or distal weight member 300B is amplified. Finally, testing showed that the effect of the proximal weight member 300A and distal weight member 300B is more profound for golfers with a higher rotation offset ratio than those with a lower rotation offset ratio. While FIG. 12 is directed to drivers, the trends also apply to other clubs including for example, fairways, hybrids, irons, and wedges.

Testing has showed that a proximal weight member 300A tends to result in a slightly open clubface at impact relative to an otherwise identical golf club 100 not incorporating a proximal weight member 300A or distal weight member 300B. Testing has also showed that a distal weight member 300B tends to result in a slightly closed clubface at impact relative to an otherwise identical golf club 100 not incorporating a proximal weight member 300A or distal weight member 300B. The effect of the proximal weight member 300A and distal weight member 300B on the face angle of the club at impact are understood to be at least partially responsible for the change in dispersion distance for golf shots relative to shots hit with a standard golf club 100 not utilizing improved weight distribution. As discussed earlier, a closed clubface at impact can cause a pull 40, a draw 60, or a pull-draw and an open clubface at impact can cause a push 50, a fade 70, or a push-fade. It is important to note that proximal weight member 300A and distal weight member 300B can affect other aspects of the swing other than just face angle at impact, some of which may also have an impact on dispersion distance.

Figure 13A:
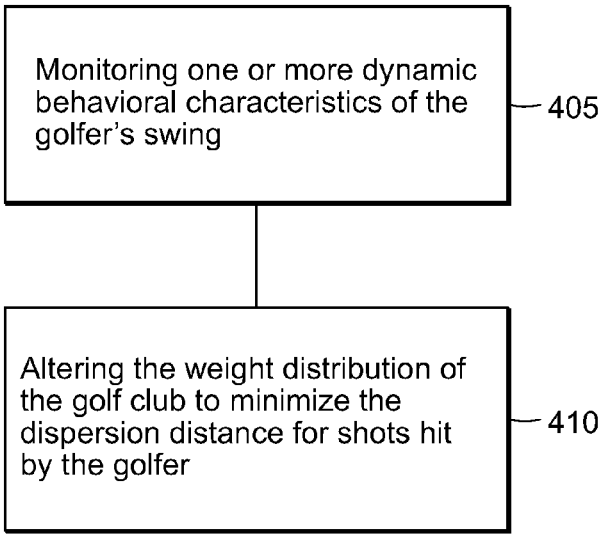
FIGS. 13A-13E illustrate processes for determining the optimal golf club weight distribution for a golfer.
Figure 13B:
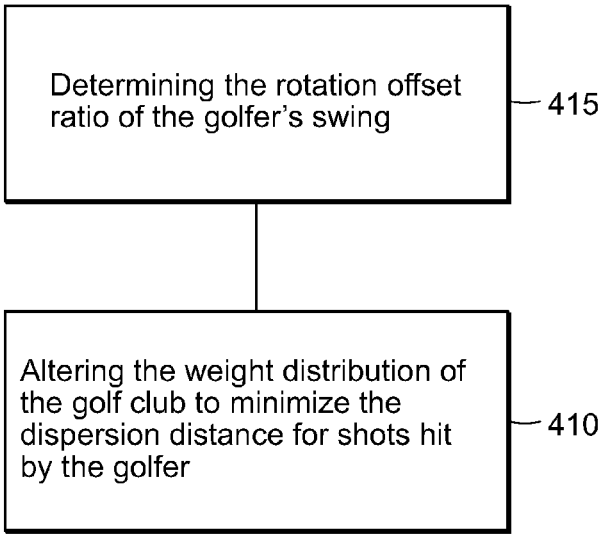
Figure 13C:
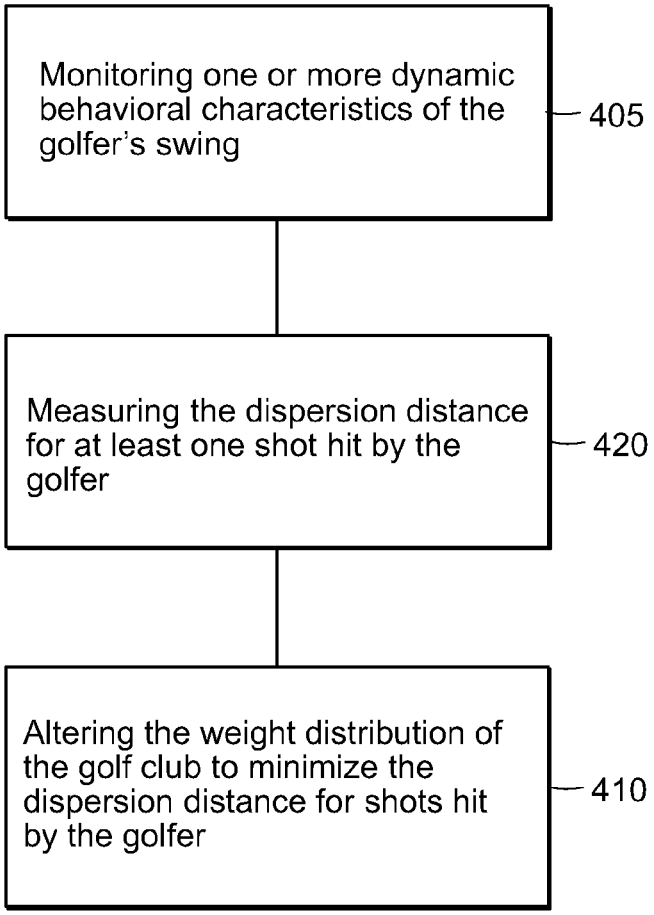
Figure 13D:
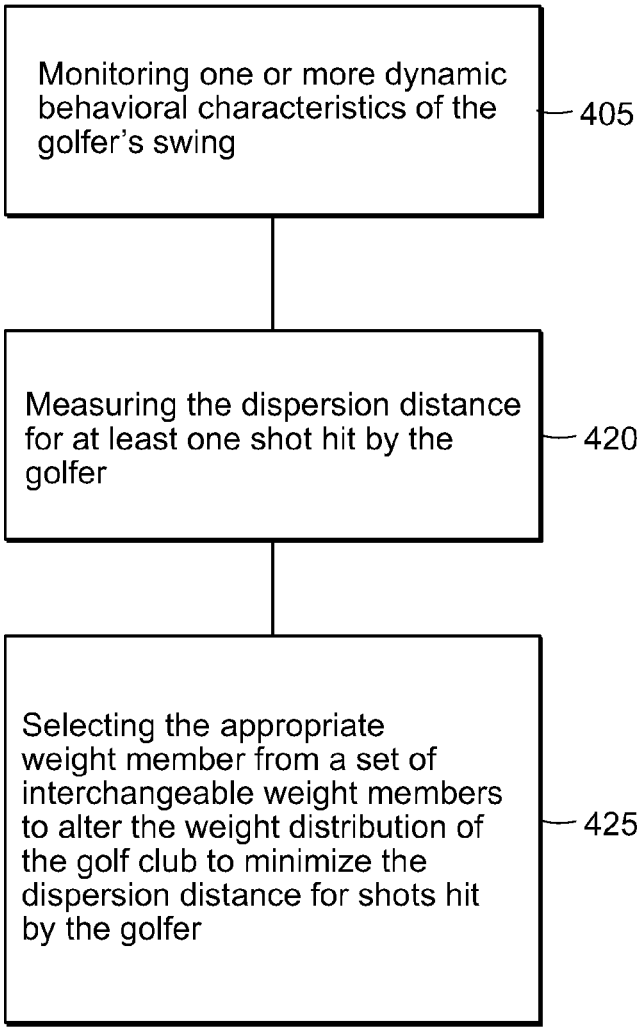

In some embodiments, a golfer 10 can go through a fitting process to determine the optimal golf club weight distribution for their swing to minimize their dispersion distance. FIGS. 13A-13E illustrate processes for determining the optimal golf club weight distribution for a golfer 10. As illustrated in FIG. 13A, in some embodiments, the fitting process can include a step 405 comprising monitoring one or more dynamic behavioral characteristics of the golfer's swing. In some embodiments, the characteristics can be monitored, measured or calculated utilizing the fitting system described in the Margoles application. An additional step 410 can include the weight distribution of the golf club 100 being altered to minimize the dispersion distance for shots hit by the golfer 10. In some embodiments, the dynamic behavioral characteristics can include rotation angle α. In some embodiments, the dynamic behavioral characteristics can include grip-ball offset Dx. In some embodiments, as illustrated in a step 415 of FIG. 13B, the dynamic behavioral characteristics can include the rotation offset ratio of the golfer's swing. In some embodiments, as illustrated in FIG. 13C, the fitting process can include a step 420 comprising measuring the dispersion distance for at least one shot hit by the golfer 10. The dispersion distance measured can be utilized to determine the amount of ball flight correction necessary and thus the appropriate weight distribution of the golf club 100 to minimize the dispersion distance for shots hit by the golfer 10. In some embodiments, as illustrated in FIG. 13D, the fitting process can include a step 425 comprising selecting the appropriate weight member from a set of interchangeable weight members to alter the weight distribution of the golf club 100 to minimize the dispersion distance for shots hit by the golfer 10.

Figure 13E:
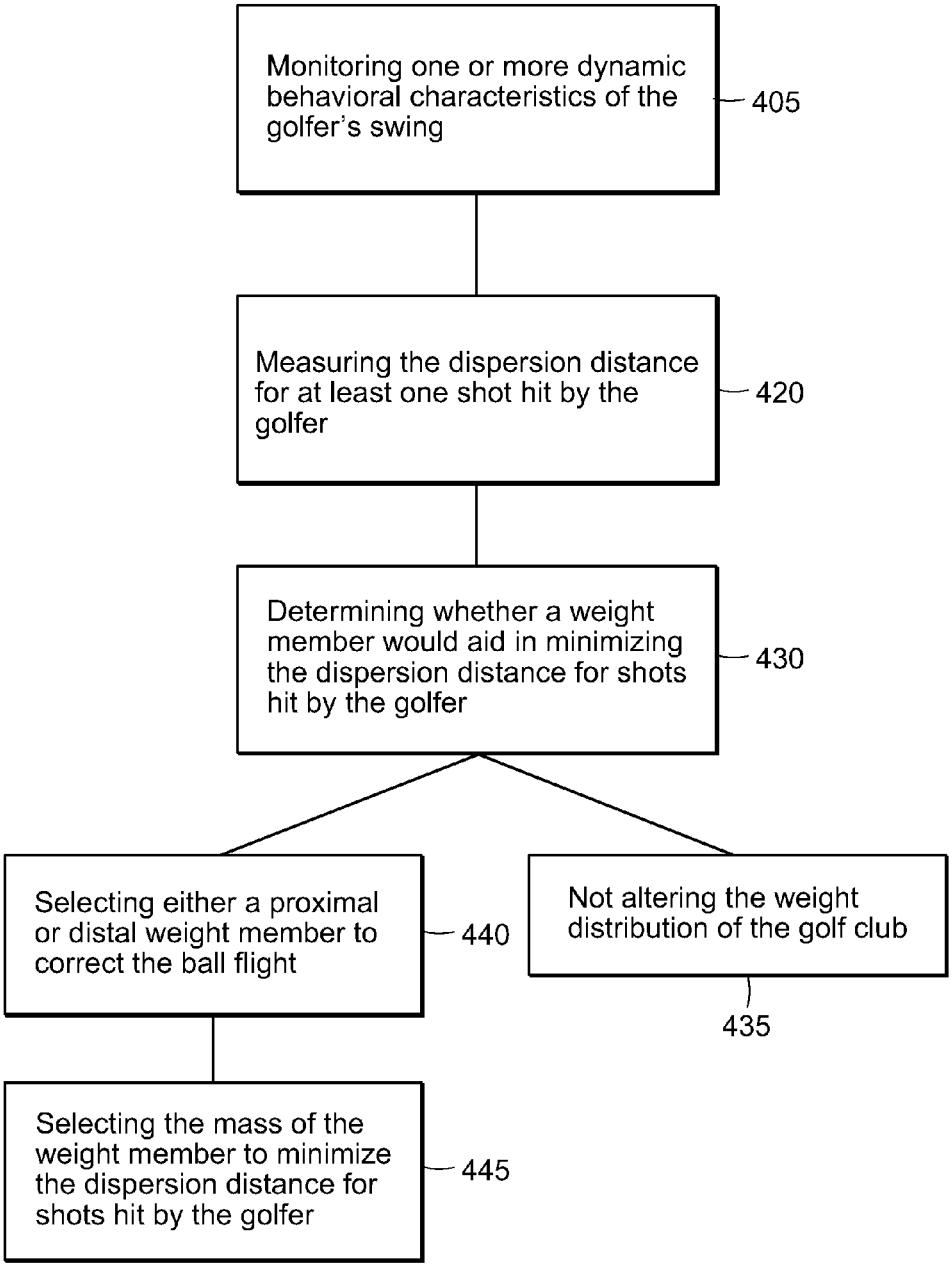

In some embodiments, as illustrated in FIG. 13E, the fitting process can include a step 430 comprising determining whether a weight member would aid in minimizing the dispersion distance for shots hit by the golfer 10. An additional step 435 can include not altering the weight distribution of the club if the golfer 10 is already hitting their shots along the target line 30. If the golfer 10 is hitting their shots either left or right of the target line 30, an additional step 440 can comprise selecting either a proximal weight member 300A or a distal weight member 300B to correct the ball flight. An additional step 445 can comprise selecting the mass of the weight member to suit the amount of correction desired and minimize the dispersion distance for shots hit by the golfer 10.

As described above, the right handed golfer 10 illustrated in FIGS. 5-8 has a rotation offset ratio of approximately 300 Degrees/Meter. Let's assume for example, that the golfer 10 illustrated in FIGS. 5-8 consistently hits the ball 20 left of the target line 30, averaging approximately 8 yards dispersion distance and would like to minimize their dispersion distance. Based on the testing and trends described above and represented in FIG. 12, the fitting system would recommend a proximal weight member 300A to alter the weight distribution of the golf club 100 causing the ball flight to be corrected to the right towards the target line 30 and minimizing the dispersion distance for shots by the golfer 10 utilizing the golf club 100 with the proximal weight member 300A. Since the golfer 10 was averaging approximately 8 yards dispersion distance to the left of the target line 30 and has a 300 Degree/Meter rotation offset ratio, as illustrated in FIG. 12, the fitting system can recommend a 60 gram proximal weight member 300A to offer the correct amount of ball flight correction to bring the ball's flight back towards the target line 30. If the golfer 10 had a higher rotation offset ratio, a smaller proximal weight member 300A may be appropriate. If the golfer 10 had a lower rotation offset ratio, a larger proximal weight member 300A may be appropriate. If, on the other hand, the golfer 10 had been consistently hitting the ball 20 right of the target line 30, the fitting system may have recommended a distal weight member 300B. In some embodiments, the fitting process can further comprise evaluating ball flight and dispersion distance once the golfer's club has been fitted with the recommended weight member. In some embodiments, at least a portion of the process can be repeated to further fine tune the weight distribution of the golf club 100. In some embodiments, the adjustable weight member system can include a single proximal weight member and a single distal weight member, and the fitting system can recommend either the proximal weight member or the distal weight member, depending on whether the golfer is hitting left or right of the target line.

Figure 14A:
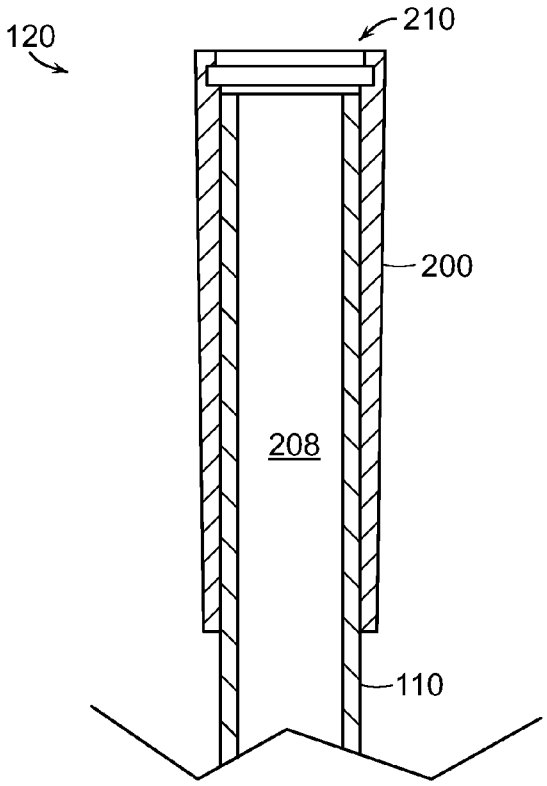
FIG. 14A illustrates a cross sectional view of one embodiment of a weight receiving grip.
Figure 14B:
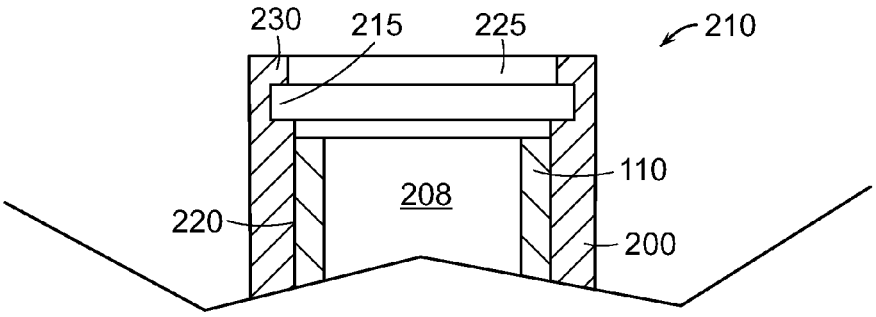
FIG. 14B illustrates a portion of the weight receiving grip of FIG. 14A.

FIG. 14A illustrates a cross sectional view of one embodiment of a weight receiving grip 200 and FIG. 14B illustrates a portion of the weight receiving grip 200. In some embodiments, the adjustable weight member system can include a weight receiving grip 200. The grip 200 can comprise a generally tubular member having a shaft bore 208 and be configured to surround the proximal portion of the shaft 110. The grip can include a weight retention portion 210 at a proximal end 120 of the grip. The weight retention portion 210 can be configured to receive a weight member. In some embodiments, the weight retention portion 210 is configured to receive a proximal weight member 300A. In some embodiments, the weight retention portion 210 is configured to receive a distal weight member 300B. In some embodiments, as illustrated in FIGS. 14A and 14B, the weight retention portion 210 is capable of receiving either a proximal weight member 300A or a distal weight member 300B. As illustrated in FIG. 14B, the weight retention portion 210 includes a cavity 215 configured to receive and retain a portion of a weight member 300A, 300B, 300C. The cavity 215 is formed in the internal surface 220 of the grip. The cavity 215 comprises a larger diameter than the internal surface 220 of the grip. In some embodiments, the weight retention portion 210 can include a bore 225 configured to receive a weight member 300A, 300B, 300C as the weight member 300A, 300B, 300C is being installed or removed from the golf club 100.

Figure 15:
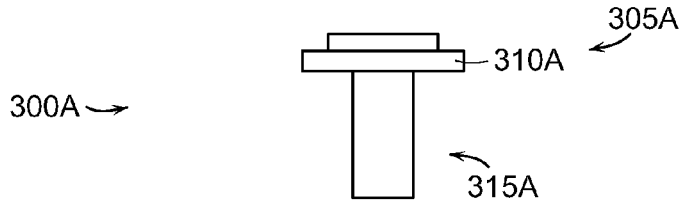
FIG. 15 illustrates a side view of one embodiment of a proximal weight member.

FIG. 15 illustrates one embodiment of a proximal weight member 300A. In some embodiments, the proximal weight member 300A can include a grip coupling portion 305A. The grip coupling portion 305A can be configured to engage the grip 200. In some embodiments, the grip coupling portion 305A can be configured to engage the weight retention portion 210 of the grip 200. In some embodiments, the grip coupling portion 305A can be configured to engage the cavity 215 of the grip 200. In some embodiments, the grip coupling portion 305A can include a grip engaging member 310A configured to engage the cavity 215 of the grip 200. In some embodiments, the proximal weight member 300A can be substantially circular in shape and the grip engaging member 310A can comprise a diameter larger than the rest of the proximal weight member 300A. In some embodiments, the diameter of the grip engaging member 310A can be substantially the same as the diameter of the cavity 215 of the grip 200. In some embodiments, the diameter of the grip engaging member 310A can be slightly larger or smaller than the diameter of the cavity 215 of the grip 200. The thickness of the grip engaging member 310A can also be substantially the same as the height of the cavity 215 of the grip 200 such that the grip engaging member 310A can reside within the cavity 215 of the grip 200 and retain the proximal weight member 300A in the grip 200.

Figure 17:
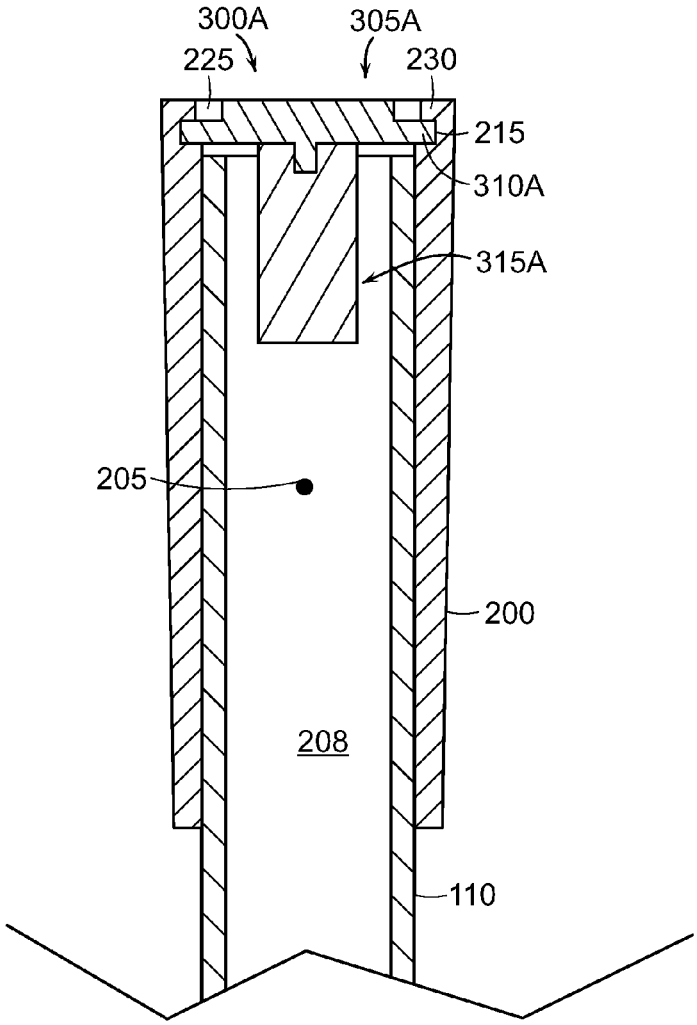
FIG. 17 illustrates a cross sectional view of the proximal weight member of FIG. 15 installed in the grip of FIGS. 14A and 14B.

In some embodiments, the proximal weight member 300A can also include a heavy weighted portion 315A. The heavy weighted portion 315A can be located distally of the grip engaging member 310A. The heavy weighted portion 315A can be adjacent the grip coupling portion 305A. In some embodiments, the heavy weighted portion 315A can be formed integrally with the grip coupling portion 305A. As illustrated in FIG. 17, the heavy weighted portion 315A can be formed separately from the grip coupling portion 305A and affixed to the grip coupling portion 305A. In some embodiments, the heavy weighted portion 315A can range anywhere from approximately 5 grams to 150 grams. In some embodiments, a plurality of weight members can be provided which may include a few mass options for the proximal weight member 300A, which may include for example, 15 grams, 30 grams, 45 grams, and 60 grams. In some embodiments, the golf club 100 can utilize a low weight shaft 110 to offset the addition of a proximal weight member 300A or distal weight member 300B. In some embodiments, the low weight shaft 110 can comprise a mass between approximately 45 grams and 60 grams and more preferably between approximately 50 and 55 grams. In some embodiments, the golf club 100 can utilize a low weight grip 200 to offset the addition of a proximal weight member 300A or distal weight member 300B. In some embodiments, the low weight grip 200 can comprise a mass between approximately 20 grams and 50 grams, more preferably between approximately 25 and 40 grams, and more preferably between approximately 30 and 35 grams.

Figure 16:
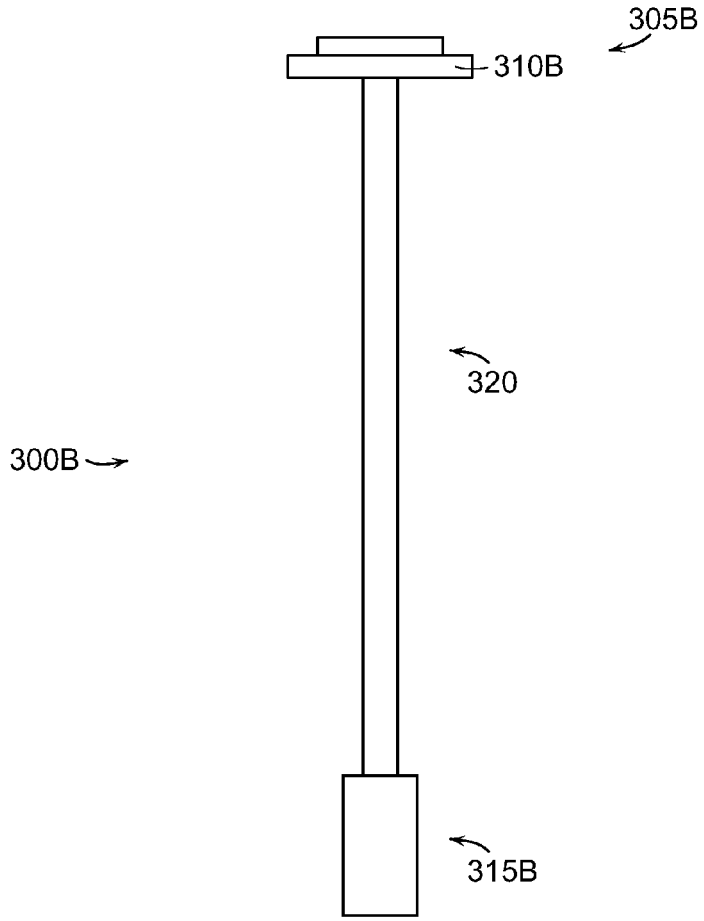
FIG. 16 illustrates a side view of one embodiment of a distal weight member.

FIG. 16 illustrates one embodiment of a distal weight member 300B. In some embodiments, the distal weight member 300B can include a grip coupling portion 305B as described above in reference to the proximal weight member 300A. In addition, the distal weight member 300B can include a heavy weighted portion 315B as described above in reference to the proximal weight member 300A. The heavy weighted portion 315B of the distal weight member 300B, as illustrated in FIG. 16, is offset distally from the grip coupling portion 305B, and thus the proximal end 120 of the grip. In some embodiments, the heavy weighted portion 315B can be affixed to the grip coupling portion 305B via a weight rod 320. In some embodiments, the grip coupling portion 305B, weight rod 320, and heavy weighted portion 315B can be formed integrally. In some embodiments, the grip coupling portion 305B, weight rod 320, and heavy weighted portion 315B can be formed separately and affixed to one another. In some embodiments, the grip coupling portion 305B and weight rod 320 can be formed integrally and affixed to the heavy weighted portion 315B. The components of the proximal weight member 300A or distal weight member 300B can be affixed to one another using a variety of techniques, which may include for example, bonding, threading, interference fitting, welding, brazing, adhesives, etc.

FIG. 17 illustrates a cross sectional view of the proximal weight member 300A of FIG. 15 installed in the grip 200 of FIGS. 14A and B. As illustrated in FIG. 17, the grip engaging member 310A of the proximal weight member 300A engages the cavity 215 of the grip 200, retaining the proximal weight member 300A within the grip 200 and within the golf club 100. In some embodiments, the diameter of the bore 225 of the grip 200 can be smaller than the diameter of the cavity 215 such that a proximal portion of the grip 200 forms a weight retention lip 230 configured to retain the proximal weight member 300A in the weight retention portion 210 of the grip 200. The weight retention lip 230 can abut the proximal surface of the grip engaging member 310A of the proximal weight member 300A, limiting the proximal weight member 300A from becoming dislodged from the cavity 215, and thus limiting the proximal weight member 300A from sliding out of the golf club 100.

Figure 18:
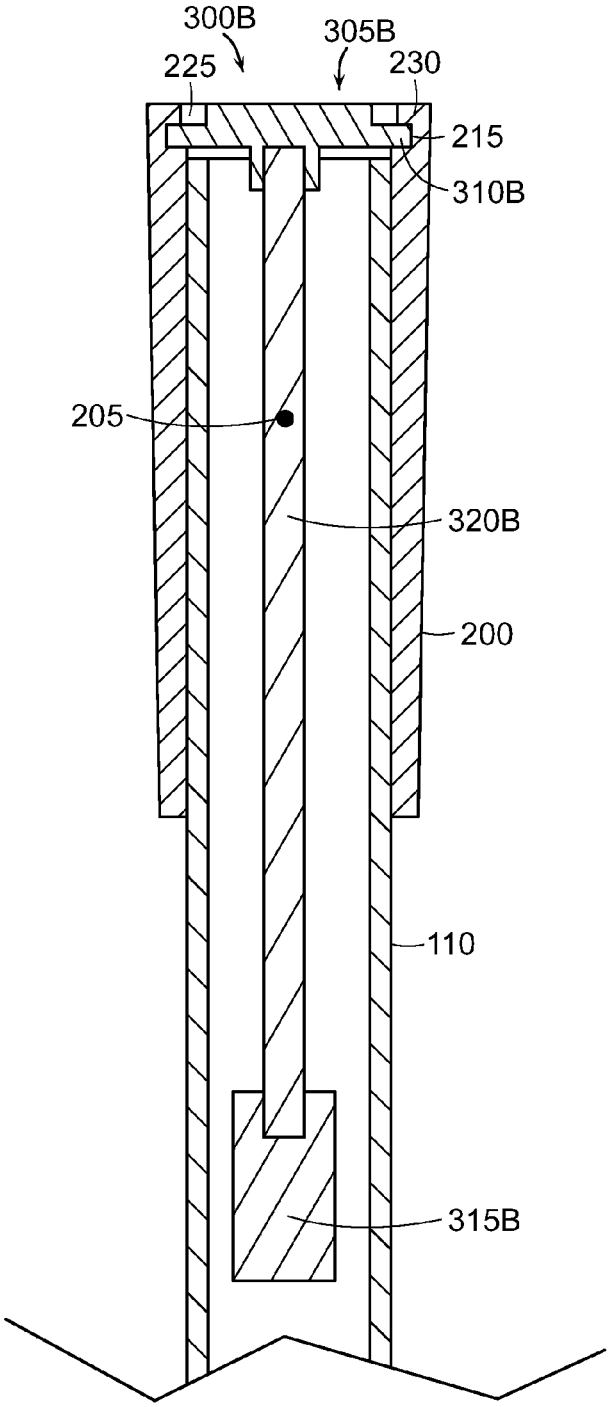
FIG. 18 illustrates a cross sectional view of the distal weight member of FIG. 16 installed in the grip of FIGS. 14A and 14B.

FIG. 18 illustrates a cross sectional view of the distal weight member 300B of FIG. 16 installed in the grip 200 of FIGS. 14A and B. In some embodiments, the grip engaging member 310B of the distal weight member 300B engages the cavity 215 of the grip 200, as described above in reference to the proximal weight member 300A. The heavy weighted portion 315B offset distally from the grip coupling portion 305B as illustrated in FIG. 18, can be located within the shaft bore 208 and inside the shaft 110.

One concern regarding weight members, particularly distal weight members 300B, is that the heavy weighted portion 315B may move within the shaft 110 and impact the inner wall 160 of the shaft 110, creating a rattle during use of the golf club 100. In some embodiments, the heavy weighted portion 315B of the distal weight member 300B can include a locating member 325 configured to limit movement of the heavy weighted portion 315B relative to the inner wall 160 of the shaft 110.

Figure 19A:
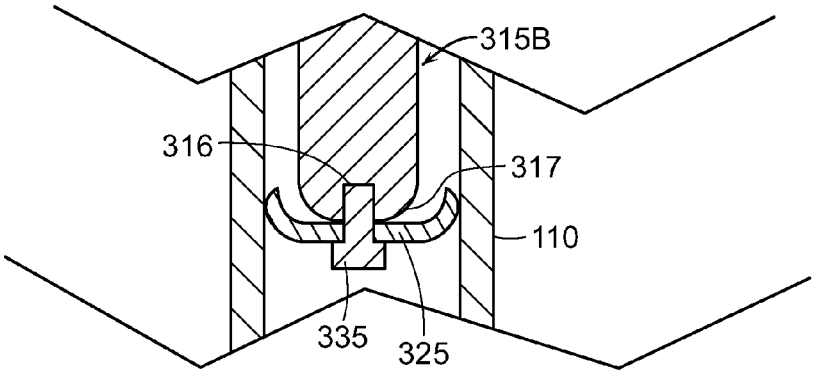
FIG. 19A-B illustrate cross sectional views of embodiments of a locating member affixed to a heavy weighted portion of a distal weight member.
Figure 19B:
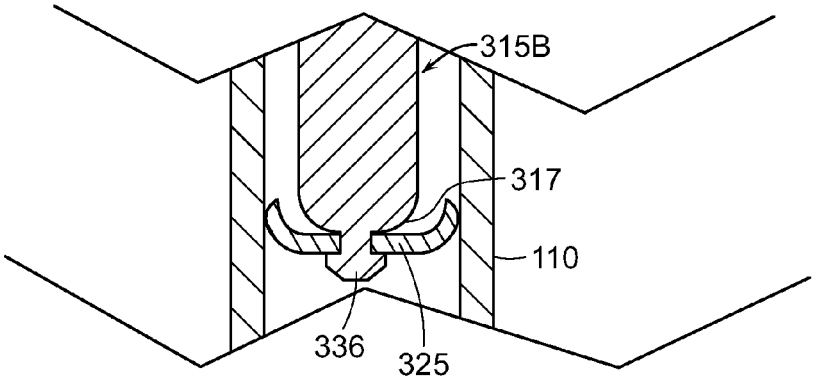
Figure 20A:
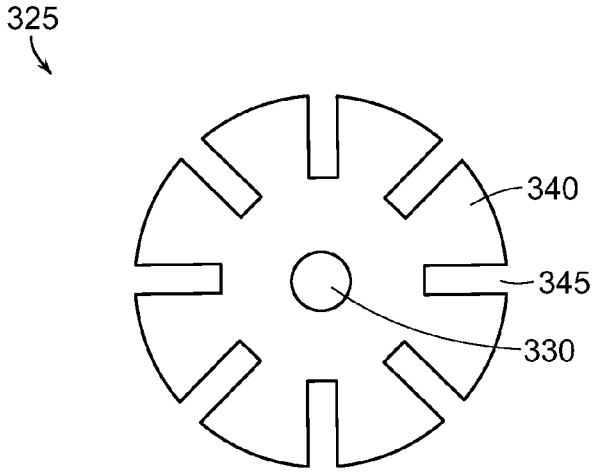
FIG. 20A-B illustrate bottom views of embodiments of a locating member.
Figure 20B:
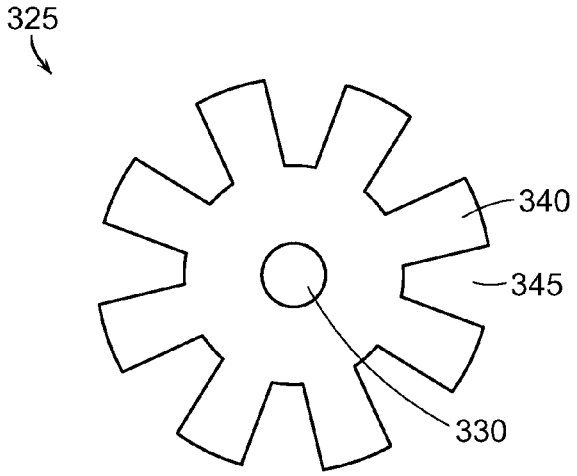

FIG. 19A-B illustrate cross sectional views of embodiments of a locating member 325 affixed to a heavy weighted portion 315B of a distal weight member 300B. FIG. 20A-B illustrate bottom views of embodiments of a locating member 325. In some embodiments, as illustrated in FIGS. 20A, and 20B, the locating member 325 can be substantially circular in shape. The locating member 325 can be affixed to the heavy weighted portion 315B. The locating member 325 can contact the inner wall 160 of the shaft 110, limiting movement of the heavy weighted portion 315B relative to the shaft 110. The locating member 325 can be configured to deflect upon insertion in the shaft 110, allowing the locating member 325 and distal weight member 300B to be installed in a variety of shafts 110, each having a different inner diameter. In some embodiments, the heavy weighted portion 315B can include a round 317 on its distal outer edge, allowing the locating member 325 to deflect and minimizing localized stresses in the locating member 325 as it deflects. In other embodiments, the heavy weighted portion 315B can include a chamfer. In some embodiments, as illustrated in FIG. 19, the locating member 325 is affixed to a distal portion of the heavy weighted portion 315B. The locating member 325 includes a central bore 330 configured to receive a fastener 335. In some embodiments, as illustrated in FIG. 19A the fastener 335 comprises a threaded portion configured to engage a threaded bore 316 in the heavy weighted portion 315B. In some embodiments, not illustrated, the fastener 335 can comprise a push in retainer clip, sometimes referred to as a Christmas tree clip. The push in retainer clip can comprise a ribbed shank which prevents the fastener 335 from backing out of the heavy weighted portion 315B once the fastener 335 has been inserted into the bore 316. In some embodiments, the bore 316 can be threaded. In other embodiments, the bore 316 can comprise ridges, ribs, roughened surfaces, etc.

In some embodiments, as illustrated in FIG. 19B, the heavy weighted portion 315B can include a locating member retention portion 336. The locating member retention portion 336 includes a protrusion extending distally from the heavy weighted portion 315B. The locating member retention portion 336 includes a groove configured to receive the locating member 325 and an enlarged portion adjacent and distal of the groove. The central bore 330 of the locating member 325 can be configured to expand as it slides over the enlarged distal portion before settling into the groove. The enlarged distal portion can then retain the locating member 325 in the groove. In an additional embodiment, not illustrated, the locating member 325 could be located on a proximal side of the heavy weighted portion 315B. The locating member 325 can be at least partially retained by the weight rod 320.

As illustrated in FIGS. 20A and 20B, the locating member 325 comprises a plurality of engaging arms 340 separated by a plurality of relief slots 345, allowing the locating member 325 to deflect upon installation within the shaft 110. The locating member 325 can be configured to cushion the heavy weighted portion 315B from the inner wall 160 of the shaft 110 as the golf club 100 impacts the ball 20. In some embodiments, as illustrated in FIG. 20A, the relief slots 345 can be substantially rectangular and the engaging arms 340 can be trapezoidal in shape. In some embodiments, as illustrated in FIG. 20B, the relief slots 345 can be trapezoidal in shape and the engaging arms 340 can be rectangular. In some embodiments, the relief slots 345 can be triangular in shape. In some embodiments, the locating member 325 can comprise one or more materials which may include, for example, plastic, thermoplastic, elastomer, polycarbonate, acetal resin, polyethylene, polypropylene, polystyrene, neoprene, rubber, etc. In other embodiments (not illustrated), the locating member 325 can comprise a compressible yet resilient material which surrounds at least a portion of the heavy weighted portion 315B. In some embodiments, the locating member 325 can comprise a foam material, preferable a closed cell foam material. In some embodiments, not illustrated, the locating member 325 can be affixed to the outer surface of the heavy weighted portion 315B. In some embodiments, the proximal weight member 300A can also utilize a locating member 325 as described above in reference to the distal weight member 300B.

Figure 21:
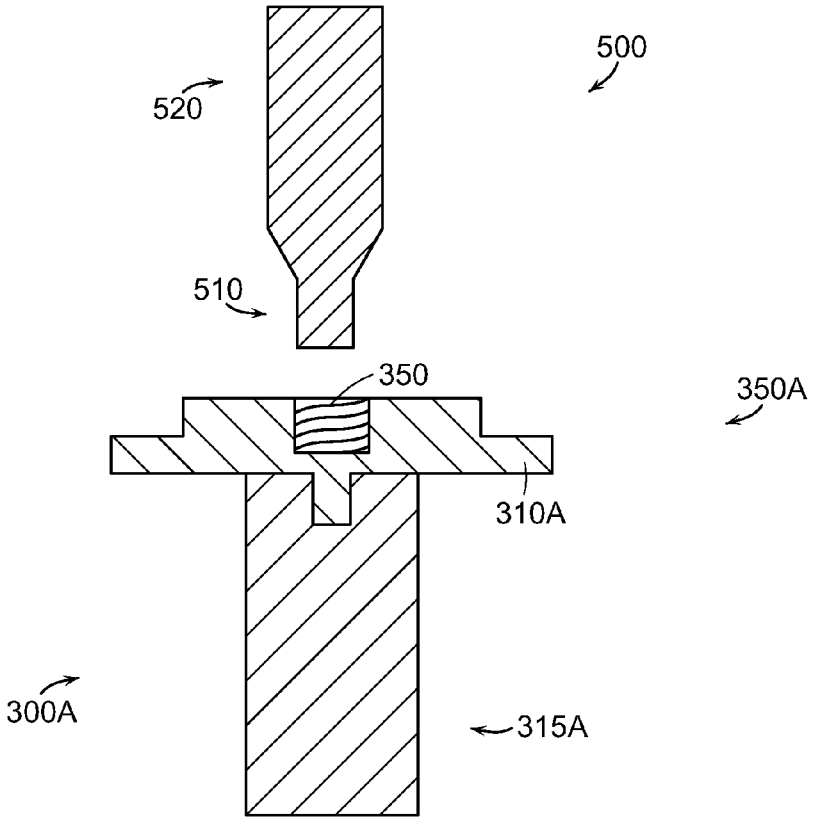
FIG. 21 illustrates a side view of on embodiment of a weight member positioning tool.
Figure 22:
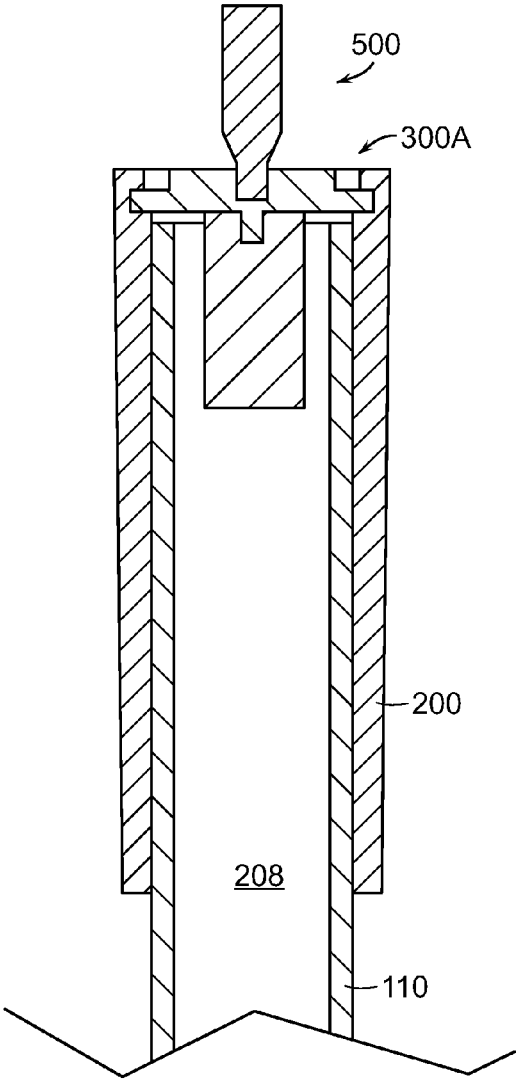
FIG. 22 illustrates a cross sectional view of the weight member positioning tool of FIG. 21 engaging a proximal weight member installed in a grip.

FIG. 21 illustrates a side view of on embodiment of a weight member positioning tool 500. FIG. 22 illustrates a cross sectional view of the weight member positioning tool 500 of FIG. 21 engaging a proximal weight member 300A installed in a grip 200. In some embodiments, the adjustable weight member system can include a weight member positioning tool 500. The weight member positioning tool 500 is configured to engage the proximal weight member 300A and distal weight member 300B, aiding in their installation and removal from a golf club 100. In some embodiments, as illustrated in FIG. 22, the distal portion 510 of the weight member positioning tool 500 is threaded and configured to threadably engage an internally threaded tool engaging portion 350 formed in a proximal portion of the weight member 300A, 300B. Once the weight member positioning tool 500 has engaged the weight member 300A, 300B, the golfer 10 can grip the proximal portion 520 of the weight member positioning tool 500 with their hand and install or remove the weight member 300A, 300B from the golf club 100.

FIG. 23 illustrates a cross sectional view of one embodiment of an unweighted cap 300C installed in a grip 200. In some embodiments, a golfer 10 may prefer a standard weight distribution in a golf club 100 and does not require a proximal weight member 300A or a distal weight member 300B. An unweighted cap 300C, such as the one illustrated in FIG. 23, which is similar in construction to the grip coupling portion 305A, 305B of the proximal weight member 300A and distal weight member 300B, however it does not include a heavy weighted portion 315A, 315B. The unweighted cap 300C can provide a consistent appearance along with the proximal weight member 300A and distal weight member 300B, without significantly changing the weight distribution of the golf club 100.

Figure 24:
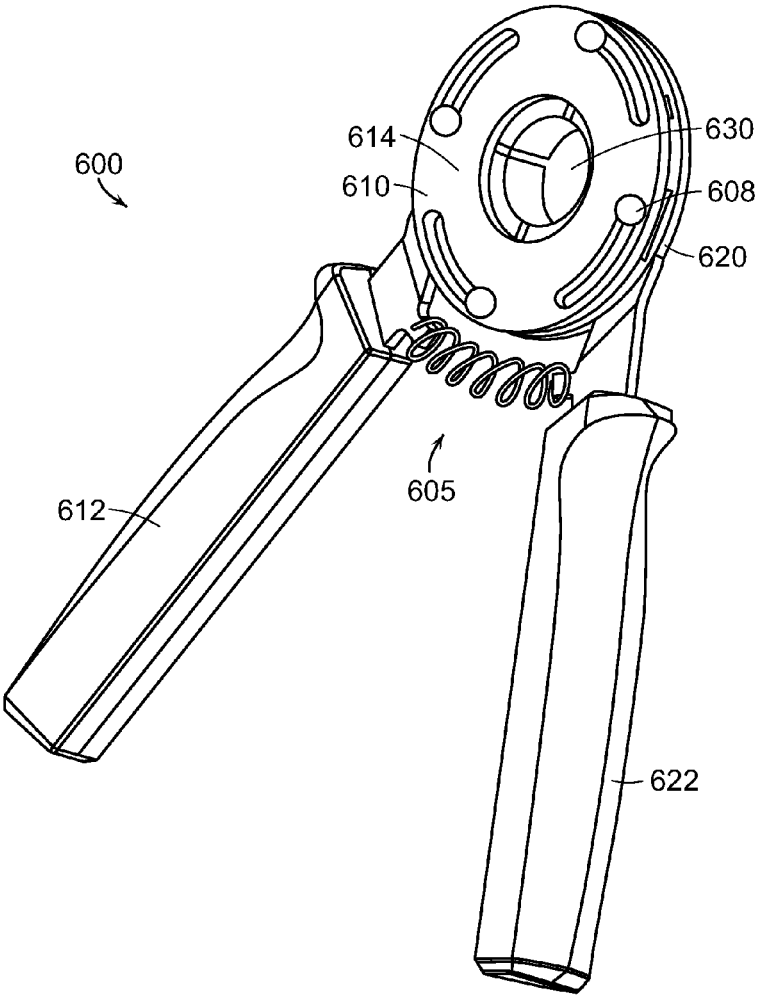
FIGS. 24 and 25 illustrate perspective views of one embodiment of a grip expansion tool.
Figure 25:
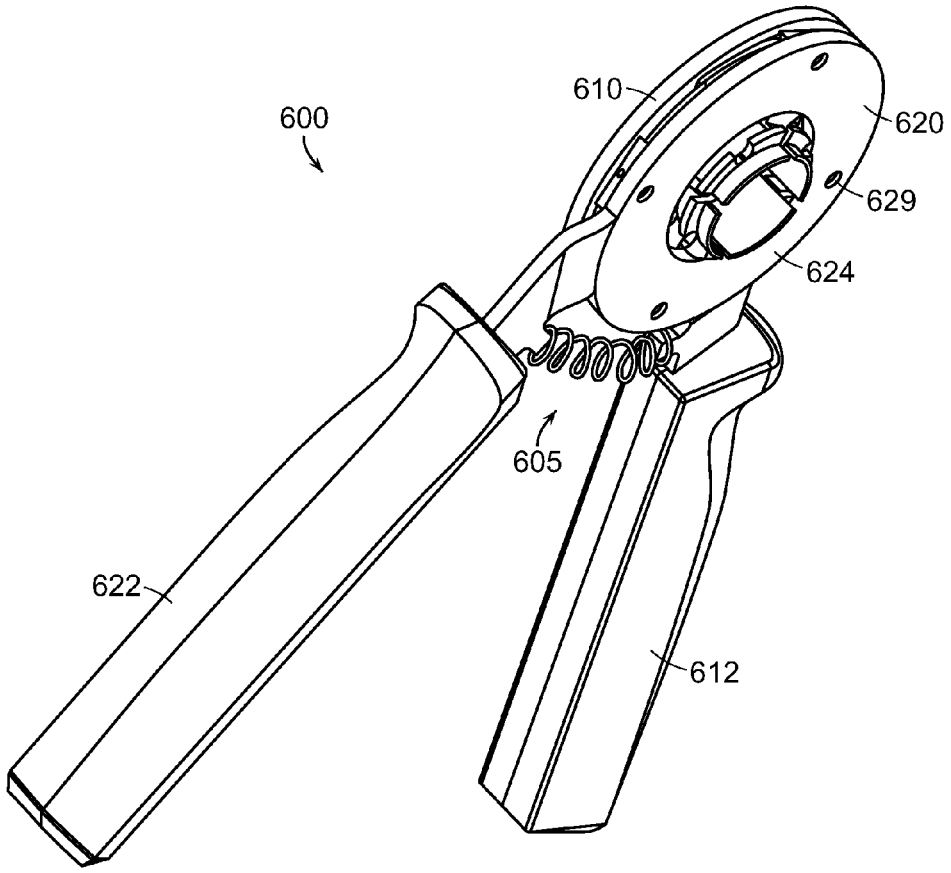

As discussed above and illustrated in FIG. 17, the grip can include a weight retention lip 230 to retain the grip coupling portion 305A, 305B of the weight member in the weight retention portion 210 of the grip 200. Inherently, the weight retention lip 230 can inhibit ease of installation and removal of the weight member 305A, 305B into the golf club 100. FIGS. 24 and 25 illustrate perspective views of one embodiment of a grip expansion tool 600. In some embodiments, the adjustable weight member system can include a grip expansion tool 600 configured to aid in the installation and removal of the weight member 305A, 305B.

As illustrated in FIGS. 24-28, the grip expansion tool 600 can be configured to expand a portion of the grip 200 to allow for installation or removal of a weight member 305A, 305B. A portion of the tool can be configured to enter the bore 225 of the grip 200 and expand the weight retention lip 230, allowing for installation or removal of the weight member 305A, 305B. The grip expansion tool 600 can include a first grip 612 and a second grip 622 configured to be engaged by the hand of the golfer 10. The grip expansion tool 600 can also include a plurality of expansion members 640 configured to engage the bore 225 of the grip. As the golfer 10 forces the first grip 612 towards the second grip 622, the expansion members engage the bore of the grip, deforming the weight retention lip 230 of the grip 200, and increasing the diameter of the inner surface of the bore 225 of the grip 200, allowing for the weight member to be installed or removed from the golf club 100.

Figure 26:
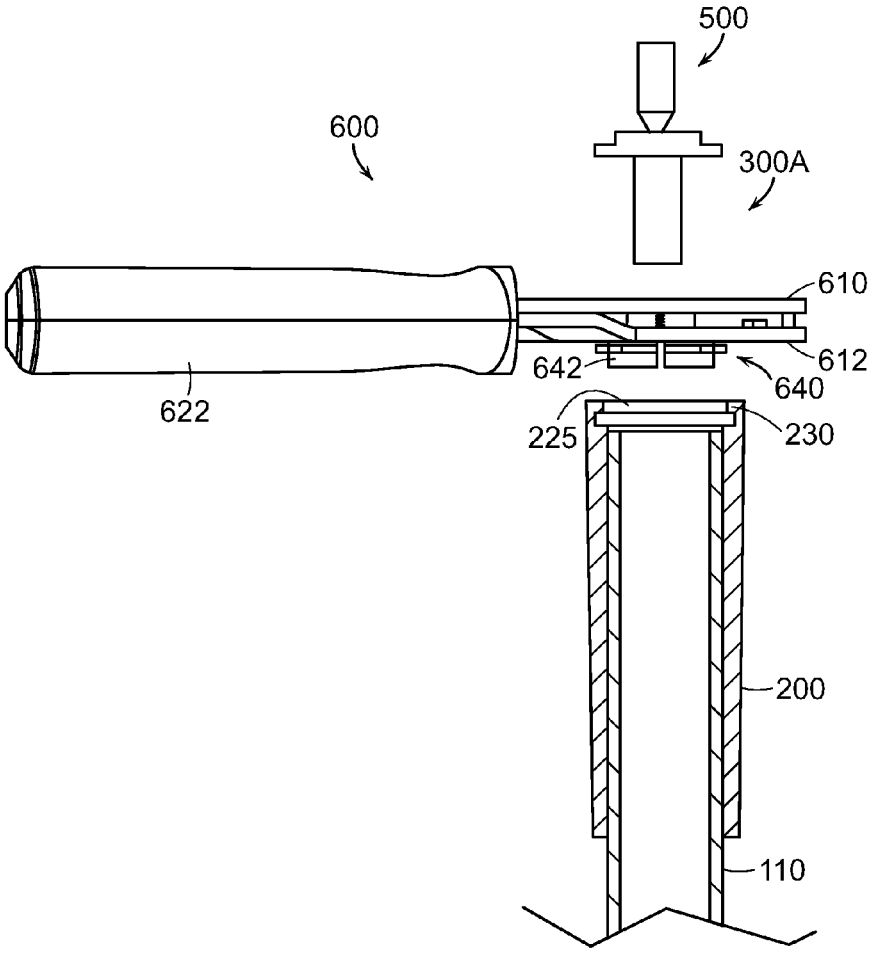
FIG. 26 illustrates a side view of a cross section of a grip below a weight member and grip expansion tool of FIGS. 24 and 25.
Figure 27:
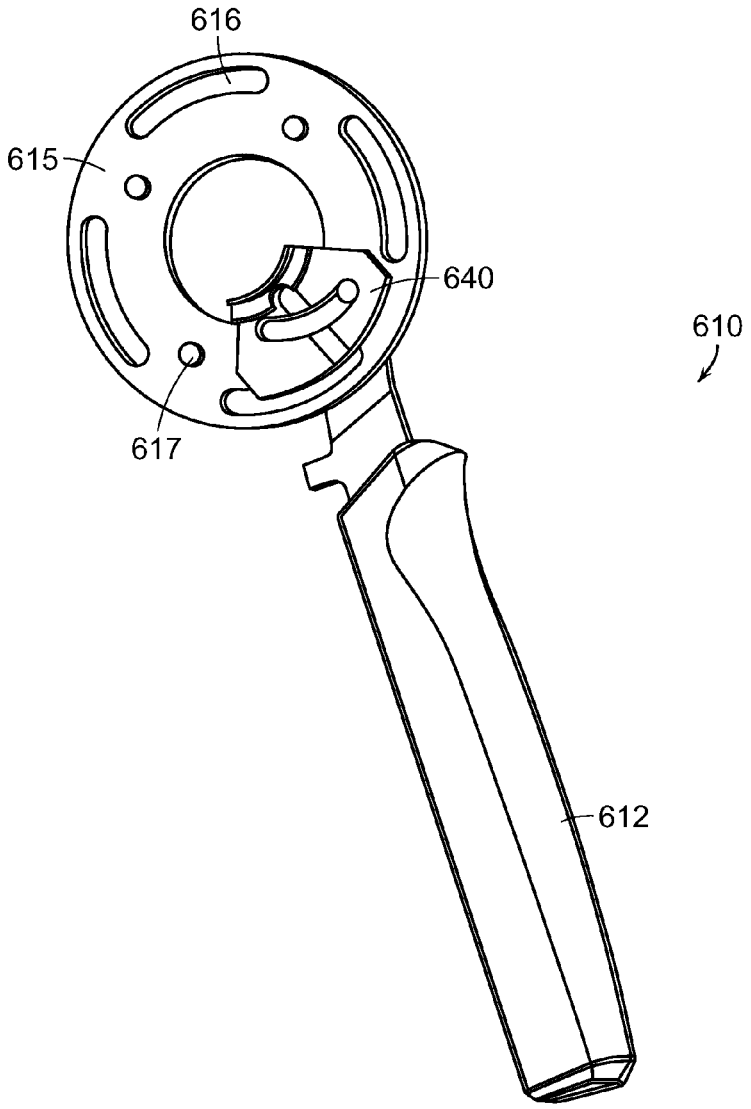
FIG. 27 illustrates a perspective view of one embodiment of a first member and expansion member of the grip expansion tool of FIGS. 24 and 25.
Figure 28:
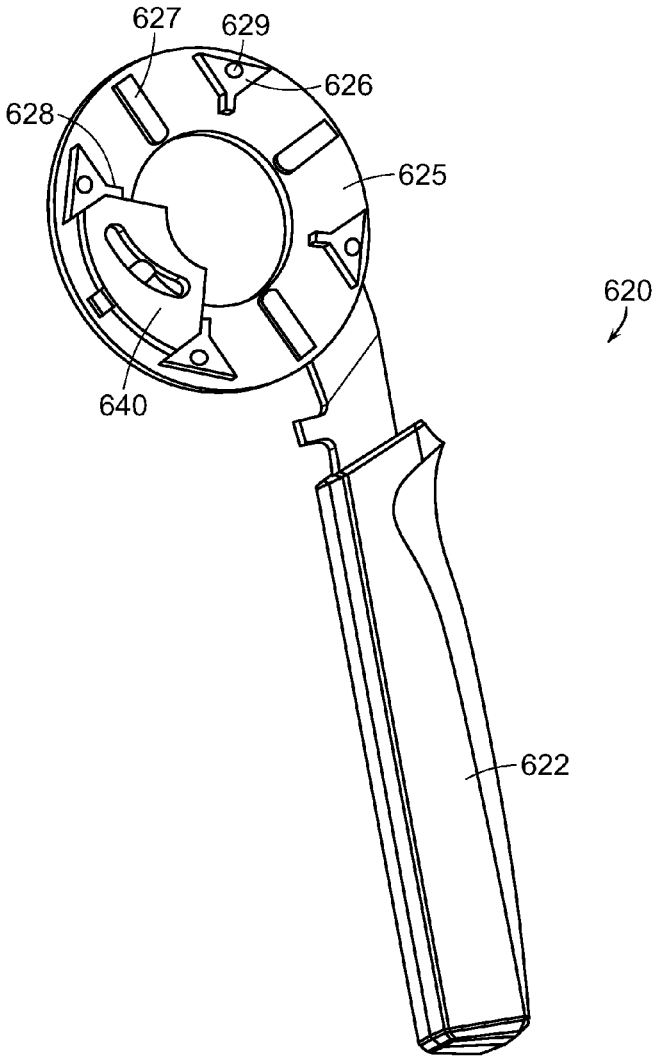
FIG. 28 illustrates a perspective view of one embodiment of a second member and expansion member of the grip expansion tool of FIGS. 24 and 25.

As illustrated in FIGS. 27-28, the grip expansion tool 600 can include a first member 610 and a second member 620. The first member 610 can be rotatably coupled to the second member 620, as illustrated in FIGS. 24-26. The first member 610 can comprise a first grip 612 and the second member 620 can comprise a second grip 622. The grip expansion tool 600 can be configured such forcing the first grip 612 towards the second grip 622 causes the first member 610 to rotate relative to the second member 620, forcing a plurality of expansion members 640 outward, increasing the diameter of the inner surface of the bore 225 of the grip 200, allowing for the weight member to be installed or removed from the golf club 100. In some embodiments, the grip expansion tool 600 includes a spring 605 configured to force the first grip 612 away from the second grip 622. The grip expansion tool 600 includes a weight insertion port 630, configured such that the weight member 300A, 300B can slide through the weight insertion port 630 while installing or removing the weight member 300A, 300B from the golf club 100.

When assembled, the expansion tool has a first outer surface 614 on the first member 610 and a second outer surface 624 on the second member 620. The grip expansion tool 600 can be placed adjacent the proximal end of the grip 200 during use, with the second outer surface 624 of the second member 620 closer to the golf club 100 and the first outer surface 614 of the first member 610 further away from the golf club. The first member 610 includes an inner surface 615, opposite the first outer surface 614. The second member 620 includes an inner surface 625, opposite the second outer surface 624.

In some embodiments, the grip expansion tool 600 can include a plurality of expansion members 640. In some embodiments, as illustrated in FIGS. 24-32, the grip expansion tool 600 includes four expansion members 640. In other embodiments, the grip expansion tool 600 can include for example, 2, 3, 5, 6, or more expansion members 640. In some embodiments as illustrated in FIGS. 24-34, each of the expansion members 640 are configured to translate as the first member 610 is rotated relative to the second member 620. Each expansion member 640 is configured to translate along a different path such that a line extending along each of the paths would intersect an axis passing through the center of the weight insertion port 630. Each of the paths are substantially perpendicular to an axis passing through the center of the weight insertion port 630. Each expansion member 640 includes a grip expanding protrusion 642 configured to engage the inner surface of the bore 225 of the grip 200. The grip expanding protrusions 642 of the plurality of expansion members 640 form a segmented and substantially circular surface configured to engage the inner surface of the bore 225 of the grip 200. As the first grip 612 is forced towards the second grip 622 and the first member 610 is rotated relative to the second member 620, the plurality of expansion members 640 are forced outward away from the center of the weight insertion port 630, effectively increasing the diameter of the substantially circular surface formed by the grip expanding protrusions 642 of the expansion members 640. In some embodiments, the second member 620 can be configured to remain stationary relative to the gold club 100 during use and the first member can be configured to rotate relative to the second member 620 as well as the golf club 100. In other embodiments (not illustrated), the plurality of expansion members 640 can be configured to be forced towards the center of the weight insertion port 630 as the grips are forced together, and as the grips are released, the force of the spring 605 forces the plurality of expansion members 640 outward away from the center of the weight insertion port 630.

Figure 29:
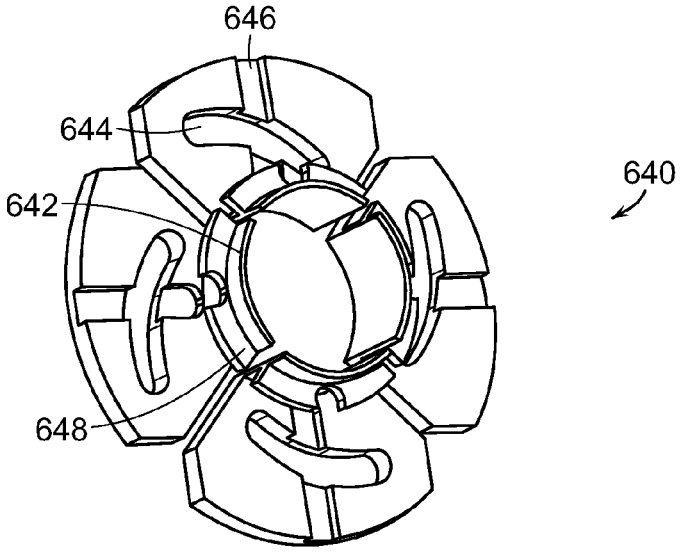
FIGS. 29 and 30 illustrate perspective views of one embodiment of the expansion members of the grip expansion tool of FIGS. 24 and 25.
Figure 32:
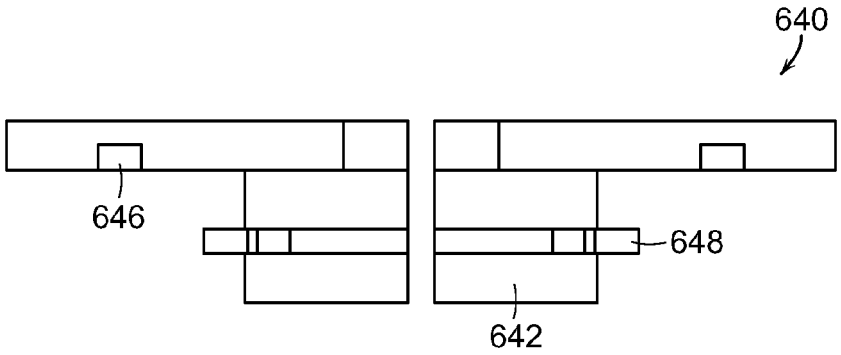
FIG. 32 illustrates a side view of the expansion members of FIGS. 29 and 30.
Figure 33:
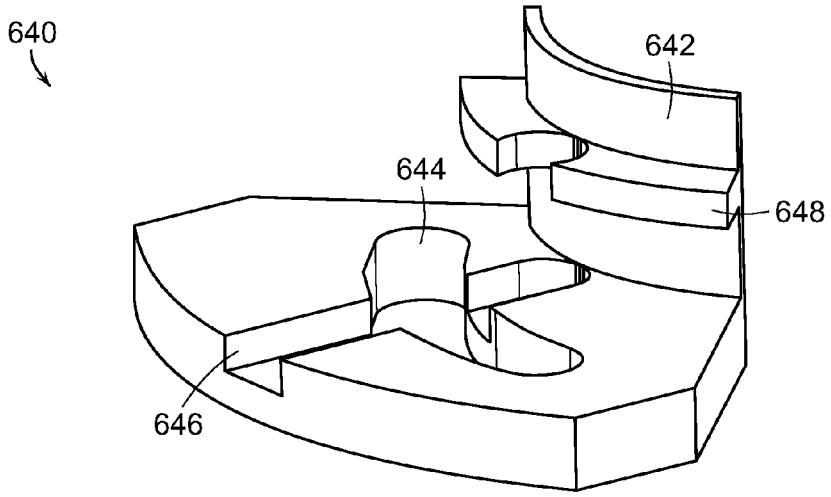
FIGS. 33 and 34 illustrate perspective views of an expansion member of FIGS. 29 and 30.
Figure 34:
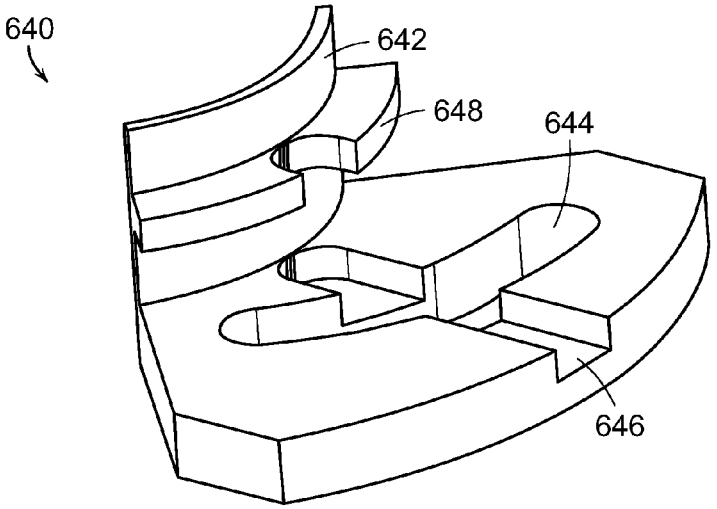

As illustrated in FIG. 26, the grip expanding protrusions 642 are configured to be inserted into the bore 225 of the grip 200. As illustrated in FIGS. 29 and 32, the grip expanding protrusions 642 include a shelf 648 configured to limit the distance the grip expanding protrusions 642 can extend into the bore 225 of the grip 200. The shelf 648 is configured to abut the weight retention lip 230 of the grip 200 as the grip expanding protrusions 642 are inserted into the bore 225 of the grip 200. In some embodiments, the shelf 648 can be located on the expanding protrusions 642 such that the expanding protrusion does not extend further into the bore 225 of the grip 200 than the thickness of the weight retention lip 230. As the first grip 612 and second grip 622 of the grip expansion tool 600 are squeezed together, the plurality of expansion members 640 are forced outward, the grip expanding protrusions 642 contacting the inner diameter of the bore 225, deforming the weight retention lip 230 of the grip 200, and increasing the diameter of the inner surface of the bore 225 of the grip 200, allowing for the weight member to be installed or removed through the weight insertion port 630, through the bore 225 of the grip, and into the golf club 100.

Figure 30:
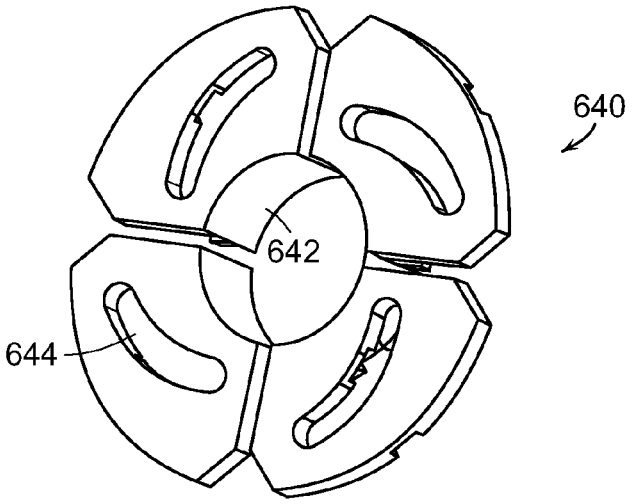
Figure 31:
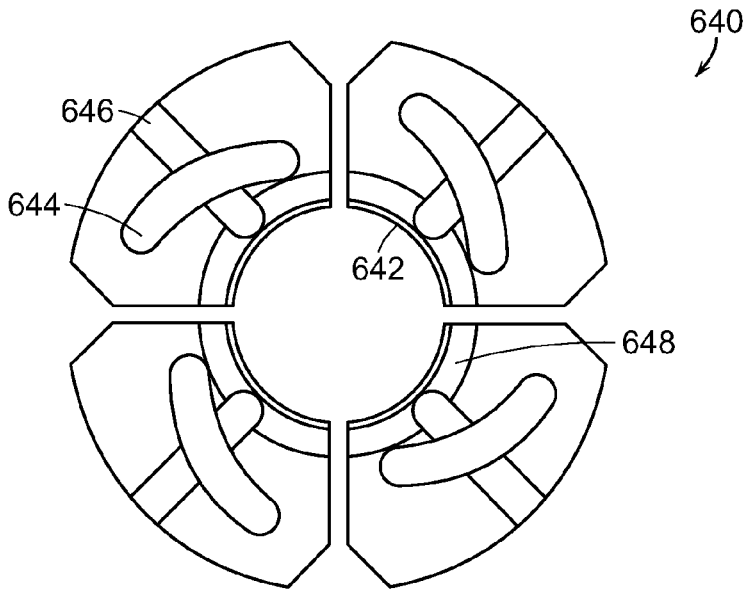
FIG. 31 illustrates a top view of the expansion members of FIGS. 29 and 30.

As illustrated in FIGS. 27-31, the plurality of expansion members 640 can include a variety of locating features causing the expansion members 640 to translate as the first member 610 is rotated relative to the second member 620. A portion of each of the plurality of expansion members 640 is configured to reside between the inner surface 615 of the first member 610 and the inner surface 625 of the second member 620. As illustrated in FIG. 27, the inner surface 615 of the first member 610 includes a plurality of slide posts 617. As illustrated in FIGS. 29-31, the plurality of expansion members 640 can each include a slide slot 644 configured to slideably receive a slide post 617. As illustrated in FIG. 28, the inner surface 625 of the second member 620 includes a plurality of guide rails 627. As illustrated in FIGS. 29-31, the plurality of expansion members 640 each includes a guide channel 645 configured to slideably receive a guide rail 627. In some embodiments, the slide slots 644 are through slots passing all the way through the expansion member 640 and the guide channels 645 are blind and do not pass all the way through the expansion member. The plurality of expansion members 640 can be installed in the grip expansion tool 600 such that the slide slots 644 slideably engage the slide posts 617 and the guide channels 645 slideably engage the guide rails 627.

In some embodiments, the guide rails 627 and guide channels 645 are aligned such that they only allow translation towards or away the center of the weight insertion port 630. The guide rails 627 and guide channels 645 are configured such that the expansion members 640 rotate with the second member 620 as the first member 610 is rotated relative to the second member 620. The slide slots 644 and slide posts 617 are configured such that as the first member 610 is rotated relative to the second member 620 and the expansion members 640 rotate relative to the first member 610, the expansion members 640 translate along the guide rails 627 either towards or away from the center of the weight insertion port 630. In some embodiments, as illustrated in FIGS. 24-34 the expansion members 640 are configured to slide away from the center of the weight insertion port 630 as the first grip 612 is squeezed towards the second grip 622. In some embodiments, the guide channel 645 and guide rail 627 effectively limits the translation travel of the expansion members 640 to provide the required range of translation travel. In other embodiments (not illustrated), the angle of the slide slot 644 could be reversed and the expansion members 640 can be configured to slide towards the center of the weight insertion port 630 as the first grip 612 is squeezed towards the second grip 622.

In some embodiments, as illustrated in FIG. 28, the grip expansion tool 600 includes a plurality of spacers 626. The spacers 626 are configured to space the inner surface 615 of the first member 610 from the inner surface 625 of the second member 620, providing clearance between the first member 610 and second member 620 so that the expansion members 640 are able to move relative to both the first member 610 and second member 620. In some embodiments the spacers 626 is affixed to the second member 620. In some embodiments, as illustrated in FIG. 28, the spacers 626 are formed integrally with the second member 620. In other embodiments, the spacers 626 can be affixed or integrally formed with the first member 610 or the spacers 626 can comprise individual parts held between the first member 610 and second member 620 with fasteners 608. In some embodiments, the first member 610 is rotatably coupled to the second member 620 via a plurality of fasteners 608 and coupling slots 616. The second member 620 can comprise fastener bores 629 and the fasteners can be configured to engage the fastener bores 629 of the second member 620. In some embodiments, the first member 610 includes a plurality of coupling slots 616, each configured to slideably receive a portion of a fastener 608. In some embodiments, the width of the coupling slot 616 is configured to complement the shank diameter of the fastener 608 but not allow the head 140 of the fastener 608 to pass through the coupling slot 616, thus fastening the first member 610 to the second member 620, yet allowing the fasteners to slide within the coupling slots 616, and thus allowing the first member 610 to rotate relative to the second member 620. In some embodiments, the spacers 626 can replace the function of the guide rails 627 by slideably interacting with the plurality of expansion members 640. In some embodiments, the spacers 626 can further guide the expansion members 640 in conjunction with the guide rails 627. In some embodiments, the spacers 626 include an abutment surface 628, limiting the travel of the expansion members 640 as illustrated in FIG. 28.

Figure 37:
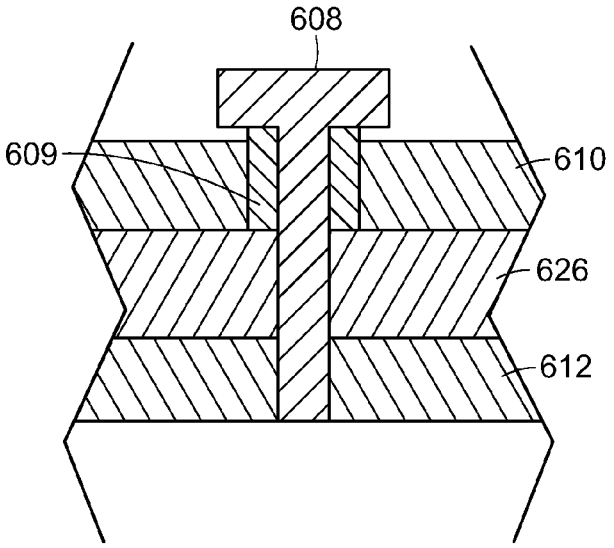
FIG. 37 illustrates one embodiment of a sleeve surrounding the shank of a fastener of the grip expanding tool.
Figure 38:
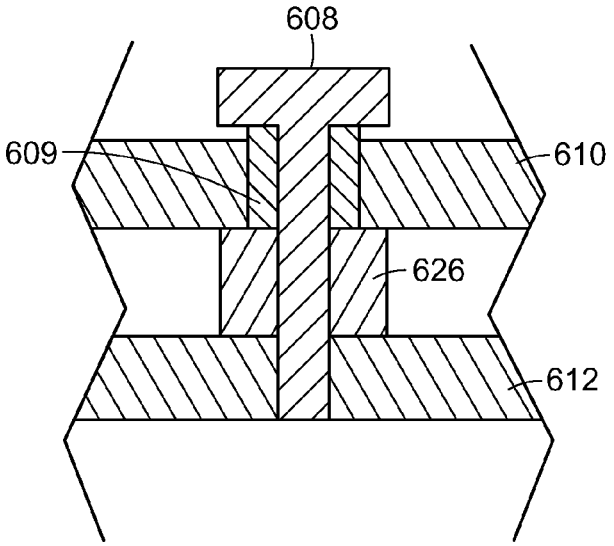
FIG. 38 illustrates an additional embodiment of a sleeve surrounding the shank of a fastener of the grip expanding tool.

In additional embodiments, as illustrated in FIG. 37, the grip expansion tool 600 can include a plurality of sleeves 609 configured to surround a portion of the shank of each fastener 608. The sleeves can include an inner diameter substantially similar to the diameter of the shank of the fastener 608 and an outer diameter substantially similar to the width of the coupling slot 616 formed in the first member 610. The height of the sleeve 609 is configured to prevent the head of the fastener 608 from bottoming out against the first member 610 and binding rotation of the first member relative to the second member. In some embodiments, the sleeve 609 is slightly taller than the thickness of the first member 610, allowing the fastener 608 to be tightened down without binding the grip expansion tool 600. In some embodiments, the sleeve 609 is configured to abut the spacer 626. In some embodiments, not illustrated, the sleeve 609 can be formed integrally with the fastener, similar to a shoulder bolt. In some embodiments, as illustrated in FIG. 38, the spacer 626 can comprise a second sleeve, the spacer 626 formed separately from the first member 610 or second member 620. The spacer 626 can include an inner diameter substantially similar to the shank diameter of the fastener and an outer diameter larger than the width of the coupling slot 616. The spacer 626 can be configured to keep the first member 610 the appropriate distance away from the second member 612, allowing the expansion members 640 to move relative to the first member 610 and second member 612.

As described herein some features of the grip expansion tool 600 may be described in reference to a first member 610 or second member 620, however in additional embodiments, those features may be applied to the opposite member and in various combinations and arrangements not specifically illustrated in the Figures.

Figure 35:
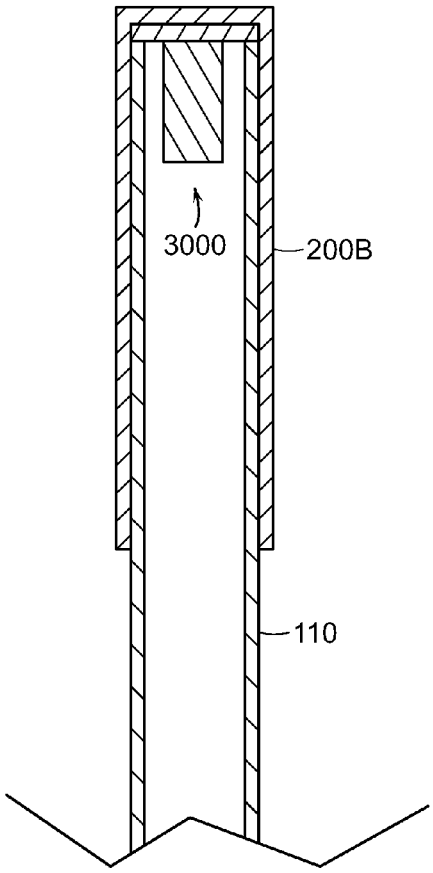
FIG. 35 illustrates a cross sectional view of one embodiment of a proximal weight member installed in a golf club utilizing a conventional grip.
Figure 36:
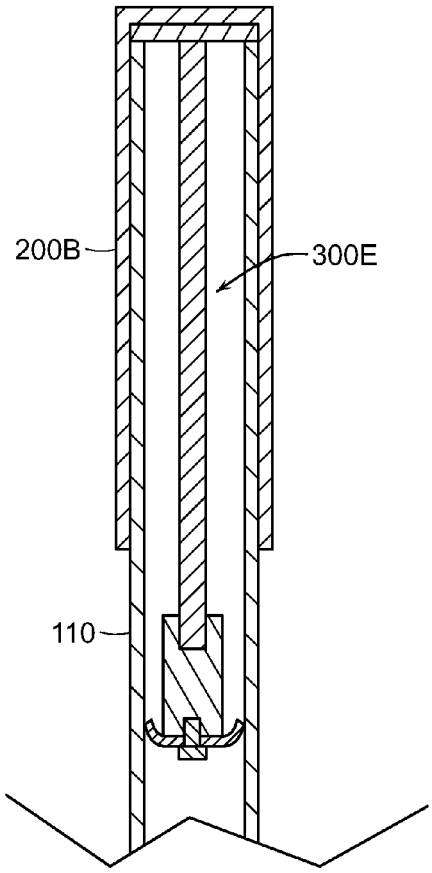
FIG. 36 illustrates a cross sectional view of one embodiment of a distal weight member installed in a golf club utilizing a conventional grip.

In some embodiments, the proximal weight member 300A and distal weight member 300B can be installed in a more permanent fashion than otherwise described herein. FIG. 35 illustrates a cross sectional view of one embodiment of a proximal weight member 300D installed in a golf club 100 utilizing a conventional grip 200B. FIG. 36 illustrates a cross sectional view of one embodiment of a distal weight member 300E installed in a golf club 100 utilizing a conventional grip 200B. As illustrated in FIGS. 35 and 36, in some embodiments, the weight members 300D, 300E are non-removable and configured to be retained by a conventional grip 200B, not requiring a cavity 215 to engage within the grip 200B, and not being removable once the grip 200B is installed. Both the proximal and distal weight members 300D, 300E illustrated in FIGS. 35 and 36 are configured to be installed in the shaft 110 prior to installing the grip 200B on the club. A golfer 10 can still go through the fitting process described above, and may even test out clubs utilizing the weight members 300A, 300B, 300C described above, then they can have one or more clubs custom built to their preferred weight distribution utilizing a non-removable proximal weight member 300D or a non-removable distal weight member 300E as illustrated in FIG. 36. Non-removable weight members 300D, 300E, when used herein, describe a weight member which cannot be removed from the golf club 100 without removing the grip 200B from the shaft 110 of the golf club 100.

The weight members and tools described herein can comprise a variety of materials. In some embodiments, the weight members can comprise one or more materials which may include for example, plastic, aluminum, steel, stainless steel, brass, lead, tungsten, composite, etc. In some embodiments, the heavy weighted portion 315A, 315B of the weight member can comprise a denser material than the grip coupling portion 305A, 305B or weight rod 320 in order to concentrate the mass of the weight member 300A, 300B in a desired location. In some embodiments, the grip expansion tool 600 can comprise one or more materials which may include for example, plastic, rubber, aluminum, steel, stainless steel, composite, etc. In some embodiments, portions of the weight members 300A, 300B, or grip expansion tool 600 can utilize fasteners to couple various portions together. In some embodiments, fasteners can comprise for example, threaded fasteners, rivets, etc. In some embodiments, the grip can comprise a flexible material which may include for example, rubber, allowing the grip expansion tool 600 to deform a portion of the grip 200 allowing for installation and removal of a weight member 300A, 300B.

Figure 39:
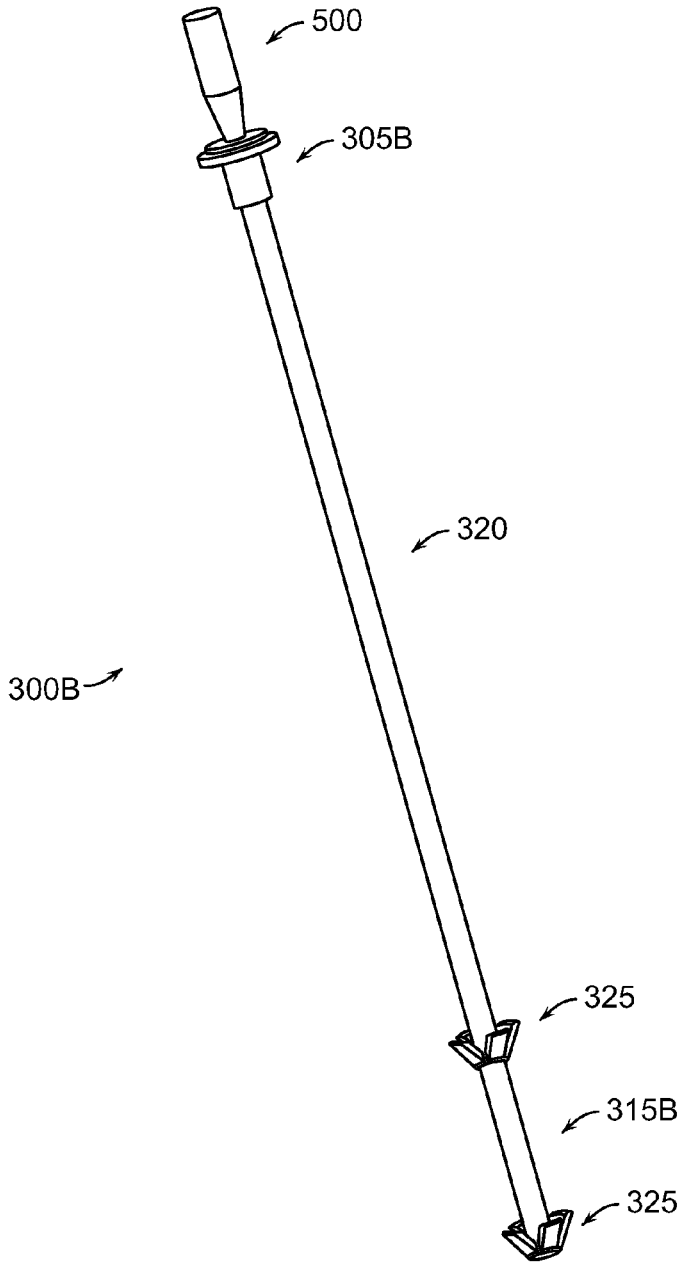
FIG. 39 illustrates a perspective view of one embodiment of a distal weight member.

FIG. 39 illustrates an additional embodiment of a distal weight member 300B. The distal weight member 300B can include a grip coupling portion 305B to engage the butt end of the grip, a heavy weighted portion 315B spaced from the butt end of the grip, and a weight rod 320 configured to affix the heavy weighted portion 315B to the grip coupling portion 305B. Additionally, as discussed earlier, the distal weight member 300B can include a locating member 325. As illustrated in FIG. 39, the distal weight member 300B can include a plurality of locating members 325. The distal weight member 300B of FIG. 39 includes two locating members 325, one above the heavy weighted portion 315B and one below the heavy weighted portion 315B. Additionally, a weight member positioning tool 500 can engage the grip coupling portion 305B and aid in the installation and removal of the distal weight member 300B from the golf club.

Figure 40:
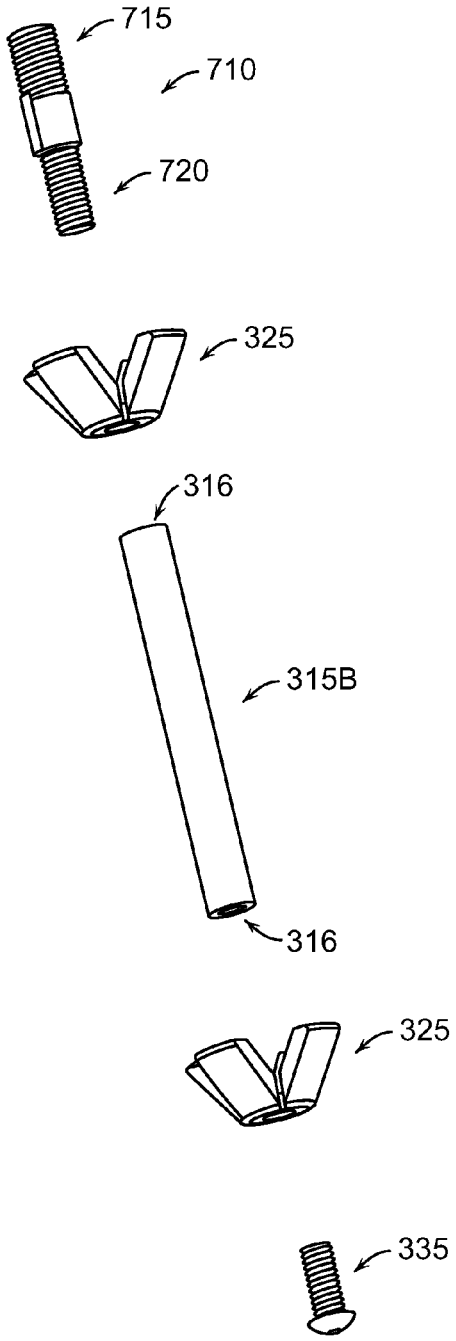
FIG. 40 illustrates an exploded view of the distal portion of the distal weight member of FIG. 39.

FIG. 40 illustrates an exploded view of the distal portion of the distal weight member 300B illustrated in FIG. 39. As illustrated in FIG. 40, the heavy weighted portion 315B can include a bore 316 located at a distal end of the heavy weighted portion 315B configured to receive a fastener 335. The fastener 335 passes through the locating member 325 and engages the bore 316, which may be threaded, affixing the locating member 325 to the distal end of the heavy weighted portion 315B. Additionally, the heavy weighted portion 315B can include a bore 316 located at a proximal portion of the heavy weighted portion 315B configured to receive the weight rod 320. As illustrated in FIG. 40, the distal weight member 300B can include a rod weight coupling member 710 configured to couple the weight rod 320 to the heavy weighted portion 315B. The rod weight coupling member 710 can include a rod engaging portion 715. The rod engaging portion 715 is configured to engage the inside wall of the weight rod 320. In some embodiments, the rod engaging portion 715 can include a roughened surface configured to enhance bonding between the rod engaging portion 715 and the weight rod 320. Additionally, the rod weight coupling member 710 can include a weight engaging portion 720 configured to engage the heavy weighted portion 315B. As illustrated in FIG. 40, the weight engaging portion 720 can comprise a male thread configured to engage the bore 316, which may be threaded, in the proximal portion of the heavy weighted portion 315B. Finally, the weight engaging portion 720 can be configured to pass through the locating member 325, affixing the locating member 325 to the proximal portion of the heavy weighted portion 315B.

Figure 41:
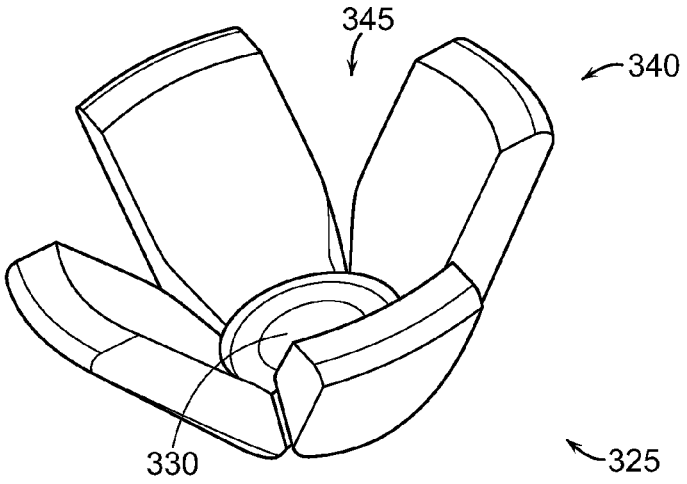
FIG. 41 illustrates a perspective view of one embodiment of a locating member.
Figure 42:
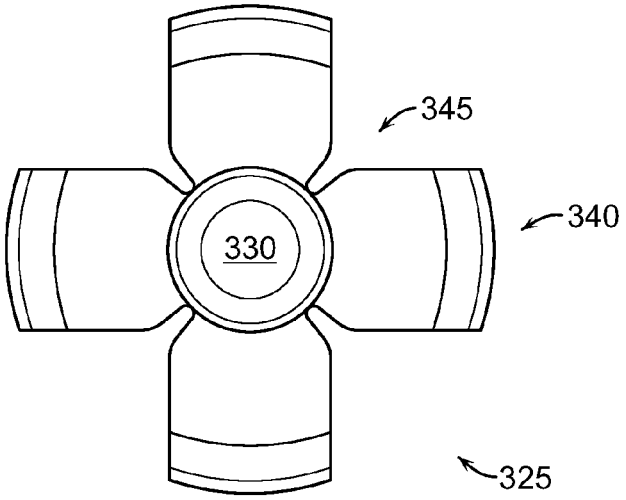
FIG. 42 illustrates a top view of the locating member of FIG. 41.

FIGS. 41 and 42 illustrate one embodiment of a locating member 325. The locating member 325 can include a plurality of engaging arms 340 and a relief slot 345 between each engaging arm 340. Additionally the locating member can include a central bore 330 configured to aid in affixing the locating member 325 to the distal weight member 300B. As illustrated in FIG. 41, the engaging arms 340 can be angled upward.

Figure 43:
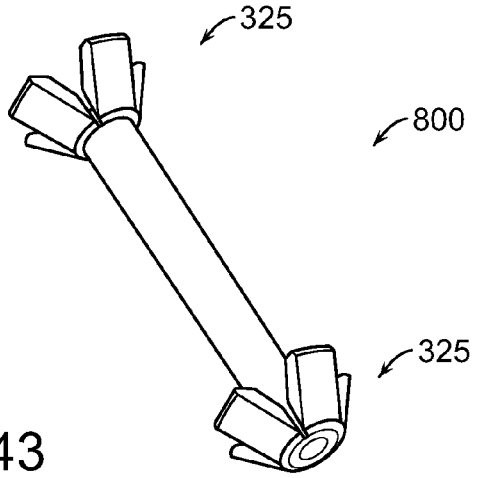
FIG. 43 illustrates a perspective view of one embodiment of a weight sleeve with locating members.

FIG. 43 illustrates an alternative version of a locating member 325. In the illustrated embodiment, a weight sleeve 800 is configured to surround at least a portion of the heavy weighted portion 315B. The weight sleeve 800 can be affixed to one or more locating members 325. As illustrated in FIG. 43, the weight sleeve 800 can be affixed to a plurality of locating members 325. In some embodiments, the weight sleeve 800 and locating members 325 can be formed monolithically. The weight sleeve 800 can then be affixed to the exterior of the heavy weighted portion 315B.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A weight member for optimizing weight distribution of a golf club, comprising:

a removable weight member configured to reside within a shaft of said golf club;

said shaft having a proximal end and a distal end, said proximal end opposite a head of said golf club, said distal end adjacent said head of said golf club;

said weight member comprising a heavy weighted portion;

said heavy weighted portion offset distally from said proximal end of said shaft;

said weight member comprising a plurality of locating members;

said plurality of locating members configured to limit movement of said heavy weighted portion relative to an inner wall of said shaft; wherein at least one of said plurality of locating members is located at a proximal end of said heavy weighted portion and at least one of said plurality of locating members is located at a distal end of said heavy weighted portion; and wherein each of said plurality of locating members comprises a plurality of engaging arms extending outwards from said heavy weighted portion.

2. The weight member of claim 1, wherein said weight member comprises a grip coupling portion configured to engage a grip of said golf club, wherein said grip coupling portion comprises a grip engaging member, said grip engaging member configured to reside within a cavity formed in said grip.

3. The weight member of claim 2, wherein said weight member further comprises a weight rod, said weight rod configured to affix said heavy weighted portion to said grip coupling portion.

4. The weight member of claim 3, wherein said heavy weighted portion is offset distally from said grip coupling portion of said weight member at least 5 inches.

5. The weight member of claim 3, wherein said weight member further comprises a rod weight coupling member, said rod weight coupling member configured to couple said weight rod to said heavy weighted portion, said rod weight coupling member configured to retain one of said plurality of locating members.

6. The weight member of claim 5, wherein said rod weight coupling member comprises a threaded portion configured to engage a threaded portion of said heavy weighted portion.

7. The weight member of claim 6, wherein each of said plurality of locating members comprises a central bore, said threaded portion of said weight rod coupling member configured to pass through said central bore of one of said plurality of locating members.

8. The weight member of claim 1, wherein each of said plurality of locating members comprises relief slots between each of said engaging arms.

9. The weight member of claim 1, wherein said plurality of locating members comprise a three dimensional geometry wherein each of said engaging arms are angled upwards towards said proximal end of said shaft.

10. The weight member of claim 1, wherein said plurality of locating members are deformable, allowing said plurality of locating members to adapt to a variety of shafts having different internal diameters as well as shafts with tapered internal diameters.

11. A weight member for optimizing weight distribution of a golf club, comprising:

a removable weight member configured to reside within a shaft of said golf club;

said shaft having a proximal end and a distal end, said proximal end opposite a head of said golf club, said distal end adjacent said head of said golf club;

said weight member comprising a heavy weighted portion;

said heavy weighted portion offset distally from said proximal end of said shaft;

said weight member comprising a plurality of locating members;

wherein each of said plurality of locating members comprises a plurality of engaging arms extending outwards from said heavy weighted portion;

wherein each of said plurality of locating members is deformable, allowing each of said plurality of locating members to adapt to a variety of shafts having different internal diameters as well as shafts with tapered internal diameters;

wherein each of said plurality of locating members is configured to limit movement of said heavy weighted portion relative to an inner wall of said shaft; and wherein at least one of said plurality of locating members is located at a proximal end of said heavy weighted portion and at least one of said plurality of locating members is located at a distal end of said heavy weighted portion.

12. The weight member of claim 11, wherein said weight member comprises a grip coupling portion configured to engage a grip of said golf club, wherein said grip coupling portion comprises a grip engaging member, said grip engaging member configured to reside within a cavity formed in said grip.

13. The weight member of claim 12, wherein said weight member further comprises a weight rod, said weight rod configured to affix said heavy weighted portion to said grip coupling portion.

14. The weight member of claim 13, wherein said weight member further comprises a rod weight coupling member, said rod weight coupling member configured to couple said weight rod to said heavy weighted portion, said rod weight coupling member configured to retain said locating member.

15. The weight member of claim 14, wherein said rod weight coupling member comprises a threaded portion configured to engage a threaded portion of said heavy weighted portion.

16. The weight member of claim 15, wherein each of said plurality of locating members comprises a central bore, said threaded portion of said weight rod coupling member configured to pass through said central bore of one of said plurality of locating members.

17. The weight member of claim 12, wherein said heavy weighted portion is offset distally from said grip coupling portion of said distal weight member at least 5 inches.

18. The weight member of claim 11, wherein each of said plurality of locating members comprises relief slots between each of said engaging arms, wherein each of said plurality of locating members comprises a three dimensional geometry wherein each of said engaging arms are angled upwards towards said proximal end of said shaft.

* * * * *